US011306895B2

(12) United States Patent
Edmond et al.

(10) Patent No.: US 11,306,895 B2
(45) **Date of Patent: *Apr. 19, 2022**

(54) TROFFER-STYLE FIXTURE

(71) Applicant: IDEAL Industries Lighting LLC, Durham, NC (US)

(72) Inventors: Mark Edmond, Raleigh, NC (US); Dong Lu, Cary, NC (US); Paul Pickard, Morrisville, NC (US); Nick Nguyen, Durham, NC (US); Gerald Negley, Durham, NC (US); Gary David Trott, Morrisville, NC (US)

(73) Assignee: IDEAL Industries Lighting LLC, Racine, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/102,852

(22) Filed: Nov. 24, 2020

(65) Prior Publication Data

US 2021/0080076 A1 Mar. 18, 2021

Related U.S. Application Data

(63) Continuation of application No. 12/873,303, filed on Aug. 31, 2010, now Pat. No. 10,883,702.

(51) Int. Cl.
*F21V 7/00* (2006.01)
*F21S 8/02* (2006.01)
(Continued)

(52) U.S. Cl.
CPC ..... *F21V 7/0008* (2013.01); *F21S 8/026* (2013.01); *F21V 7/24* (2018.02); *F21V 7/30* (2018.02);
(Continued)

(58) Field of Classification Search
CPC ..... F21S 8/026; F21V 29/74; F21V 29/745; F21V 7/0008
See application file for complete search history.

(56) References Cited

U.S. PATENT DOCUMENTS

D85,382 S 10/1931 Guth ..... D26/24
2,356,654 A 8/1944 Cullman ..... 362/223
(Continued)

FOREIGN PATENT DOCUMENTS

CN 1762061 4/2006
CN 1934389 3/2007
(Continued)

OTHER PUBLICATIONS

European Office Action dated Sep. 19, 2019 issued in counterpart European Application No. 11754767.9.
(Continued)

*Primary Examiner* — William N Harris
(74) *Attorney, Agent, or Firm* — Withrow & Terranova, P.L.L.C.

(57) ABSTRACT

An indirect troffer. Embodiments of the present invention provide a troffer-style fixture that is particularly well-suited for use with solid state light sources, such as LEDs. The troffer comprises a light engine unit that is surrounded on its perimeter by a reflective pan. A back reflector defines a reflective interior surface of the light engine. To facilitate thermal dissipation, a heat sink is disposed proximate to the back reflector. A portion of the heat sink is exposed to the ambient room environment while another portion functions as a mount surface for the light sources that faces the back reflector. One or more light sources disposed along the heat sink mount surface emit light into an interior cavity where it can be mixed and/or shaped prior to emission. In some
(Continued)

embodiments, one or more lens plates extend from the heat sink out to the back reflector.

20 Claims, 9 Drawing Sheets

(51) Int. Cl.

| | |
|---|---|
| ***F21V 29/74*** | (2015.01) |
| ***F21V 29/75*** | (2015.01) |
| ***F21V 7/30*** | (2018.01) |
| ***F21V 7/24*** | (2018.01) |
| ***F21V 13/04*** | (2006.01) |
| ***F21Y 113/13*** | (2016.01) |
| ***F21Y 103/10*** | (2016.01) |
| ***F21Y 115/10*** | (2016.01) |

(52) U.S. Cl.
CPC ..... *F21V 29/745* (2015.01); *F21V 29/75* (2015.01); *F21V 13/04* (2013.01); *F21Y 2103/10* (2016.08); *F21Y 2113/13* (2016.08); *F21Y 2115/10* (2016.08)

(56) References Cited

U.S. PATENT DOCUMENTS

| | | | | |
|---|---|---|---|---|
| 3,381,124 | A | 4/1968 | Eisenberg | 312/354 |
| 3,743,826 | A | 7/1973 | Halfaker | |
| 3,790,774 | A | 2/1974 | Miller | |
| 4,939,627 | A | 7/1990 | Herst et al. | 362/299 |
| 5,025,356 | A | 6/1991 | Gawad | 362/221 |
| 5,526,190 | A | 6/1996 | Hubble, III | 347/102 |
| 5,823,663 | A | 10/1998 | Bell et al. | 362/362 |
| D407,473 | S | 3/1999 | Wimbock | D23/328 |
| 5,988,836 | A | 11/1999 | Swarens | |
| 6,079,851 | A | 6/2000 | Altman | |
| 6,102,550 | A | 8/2000 | Edwards, Jr. | |
| 6,149,283 | A | 11/2000 | Conway et al. | 362/236 |
| 6,155,699 | A | 12/2000 | Miller et al. | 362/293 |
| 6,210,025 | B1 | 4/2001 | Schmidt et al. | 362/362 |
| 6,234,643 | B1 | 5/2001 | Lichon, Jr. | 362/147 |
| 6,402,347 | B1 | 6/2002 | Maas et al. | 362/294 |
| 6,443,598 | B1 | 9/2002 | Morgan | 362/342 |
| 6,523,974 | B2 | 2/2003 | Engel | 362/224 |
| 6,578,979 | B2 | 6/2003 | Truttmann-Battig | 362/92 |
| 6,598,998 | B2 | 7/2003 | West | 257/E33.073 |
| D496,121 | S | 9/2004 | Santoro | D26/74 |
| 6,871,983 | B2 | 3/2005 | Jacob et al. | 362/364 |
| 6,948,838 | B2 | 9/2005 | Kunstler | 362/237 |
| 6,948,840 | B2 | 9/2005 | Grenda et al. | 362/555 |
| 6,951,415 | B2 | 10/2005 | Amano | 362/297 |
| 7,021,797 | B2 | 4/2006 | Minano et al. | 362/355 |
| 7,049,761 | B2 | 5/2006 | Timmermans et al. | 315/246 |
| 7,063,449 | B2 | 6/2006 | Ward | 345/102 |
| 7,111,969 | B2 | 9/2006 | Bottesch | 362/299 |
| 7,175,296 | B2 | 2/2007 | Cok | 362/147 |
| 7,213,940 | B1 | 5/2007 | Van de Ven et al. | 362/231 |
| 7,217,004 | B2 | 5/2007 | Park et al. | 362/240 |
| 7,237,924 | B2 | 7/2007 | Martineau et al. | 362/231 |
| D556,358 | S | 11/2007 | Santoro | D26/74 |
| 7,338,182 | B1 | 3/2008 | Hastings et al. | 362/150 |
| 7,341,358 | B2 | 3/2008 | Hsieh | 362/97.1 |
| 7,510,299 | B2 | 3/2009 | Timmermans et al. | 362/225 |
| 7,520,636 | B2 * | 4/2009 | Van Der Poel | F21V 7/0008 362/290 |
| D593,246 | S | 5/2009 | Fowler et al. | D26/76 |
| 7,559,672 | B1 | 7/2009 | Parkyn et al. | 362/244 |
| 7,594,736 | B1 | 9/2009 | Kassay et al. | 362/223 |
| D604,444 | S | 11/2009 | Fowler et al. | D26/76 |
| 7,614,767 | B2 | 11/2009 | Zulim et al. | |
| 7,618,157 | B1 | 11/2009 | Galvez et al. | 362/294 |
| 7,618,160 | B2 | 11/2009 | Chinniah et al. | 362/326 |
| D608,932 | S | 1/2010 | Castelli | D26/76 |
| 7,654,688 | B2 | 2/2010 | Li | |
| 7,654,702 | B1 | 2/2010 | Ding et al. | 362/294 |
| 7,661,844 | B2 | 2/2010 | Sekiguchi et al. | 362/249 |
| D611,118 | S | 3/2010 | Duerte | D26/76 |
| 7,674,005 | B2 | 3/2010 | Chung et al. | 362/223 |
| 7,686,470 | B2 | 3/2010 | Chiang | 362/147 |
| 7,686,484 | B2 | 3/2010 | Heiking et al. | 362/375 |
| 7,712,918 | B2 | 5/2010 | Siemiet et al. | 362/241 |
| 7,722,220 | B2 | 5/2010 | Van De Ven | 362/294 |
| 7,722,227 | B2 | 5/2010 | Zhang et al. | 362/364 |
| D617,487 | S | 6/2010 | Fowler et al. | D26/76 |
| 7,768,192 | B2 | 8/2010 | Van de Ven et al. | 313/503 |
| 7,815,338 | B2 | 10/2010 | Siemiet et al. | 362/218 |
| 7,824,056 | B2 | 11/2010 | Madireddi et al. | 362/125 |
| 7,828,468 | B2 | 11/2010 | Mayfield et al. | 362/342 |
| 7,868,484 | B2 | 1/2011 | Groff et al. | 362/375 |
| D633,247 | S | 2/2011 | Kong et al. | D26/88 |
| 7,887,216 | B2 | 2/2011 | Patrick | |
| 7,922,354 | B2 | 4/2011 | Everhart | 362/235 |
| 7,926,982 | B2 | 4/2011 | Liu | 362/294 |
| 7,959,332 | B2 | 6/2011 | Tickner | |
| 7,988,321 | B2 | 8/2011 | Wung et al. | 362/218 |
| 7,988,335 | B2 | 8/2011 | Liu et al. | 362/294 |
| 7,991,257 | B1 | 8/2011 | Coleman | 264/1.24 |
| 7,993,034 | B2 | 8/2011 | Wegner | 362/296.05 |
| 7,997,762 | B2 | 8/2011 | Wang et al. | 362/249 |
| 8,038,314 | B2 | 10/2011 | Ladewig | |
| 8,038,321 | B1 | 10/2011 | Franck et al. | 362/249.02 |
| 8,061,867 | B2 * | 11/2011 | Kim | F21V 7/00 362/217.17 |
| 8,070,326 | B2 | 12/2011 | Lee | 362/307 |
| D653,376 | S | 1/2012 | Kong et al. | D26/76 |
| 8,092,043 | B2 | 1/2012 | Lin et al. | 362/249.02 |
| 8,092,049 | B2 | 1/2012 | Kinnune et al. | 362/294 |
| 8,096,671 | B1 | 1/2012 | Cronk | 362/147 |
| D657,488 | S | 4/2012 | Lown et al. | D26/120 |
| 8,162,504 | B2 | 4/2012 | Zhang et al. | 362/217 |
| 8,186,855 | B2 | 5/2012 | Wassel et al. | 362/373 |
| 8,197,086 | B2 | 6/2012 | Watanabe et al. | 362/218 |
| 8,201,968 | B2 | 6/2012 | Maxik et al. | |
| 8,215,799 | B2 | 7/2012 | Vanden Eynden et al. | 362/294 |
| 8,246,219 | B2 | 8/2012 | Teng et al. | 362/311.03 |
| 8,256,927 | B2 | 9/2012 | Hu | 362/218 |
| 8,287,160 | B2 | 10/2012 | Shen | |
| D670,849 | S | 11/2012 | Lay et al. | D26/74 |
| 8,317,354 | B2 | 11/2012 | Gassner et al. | 362/147 |
| D676,848 | S | 2/2013 | Smith et al. | D26/74 |
| 8,376,578 | B2 * | 2/2013 | Kong | F21K 9/20 362/249.02 |
| 8,410,514 | B2 | 4/2013 | Kim | 257/99 |
| D684,291 | S | 6/2013 | Goelz et al. | D26/74 |
| 8,480,252 | B2 | 7/2013 | Bertram et al. | 362/243 |
| 8,506,135 | B1 | 8/2013 | Oster | 362/373 |
| 8,523,383 | B1 | 9/2013 | Grigore | |
| 8,556,452 | B2 | 10/2013 | Simon | 362/217.07 |
| 8,591,011 | B2 | 11/2013 | Shimada et al. | 362/294 |
| 8,591,058 | B2 | 11/2013 | Concepcion | 362/231 |
| 8,602,601 | B2 | 12/2013 | Khazi | 362/249.02 |
| 8,616,723 | B2 | 12/2013 | Zhang | 362/218 |
| D698,975 | S | 2/2014 | Blessit et al. | D26/74 |
| 8,641,243 | B1 | 2/2014 | Rashidi | 362/373 |
| D701,988 | S | 4/2014 | Clements | D26/74 |
| 8,696,154 | B2 | 4/2014 | Hutchens | 362/217.05 |
| 8,702,264 | B1 | 4/2014 | Rashidi | 362/147 |
| 8,764,244 | B2 | 7/2014 | Jeon | 362/218 |
| D714,988 | S | 10/2014 | Park et al. | D26/74 |
| D721,198 | S | 1/2015 | Glasbrenner | D26/76 |
| 9,010,956 | B1 | 4/2015 | Davis | |
| 9,052,075 | B2 | 6/2015 | Demuynck et al. | |
| 2003/0063476 | A1 | 4/2003 | English et al. | |
| 2004/0001344 | A1 * | 1/2004 | Hecht | F21V 29/74 362/555 |
| 2004/0085779 | A1 | 5/2004 | Pond et al. | 362/516 |
| 2004/0100796 | A1 | 5/2004 | Ward | |
| 2004/0240230 | A1 | 12/2004 | Kitajima | 362/558 |
| 2005/0180135 | A1 | 8/2005 | Mayer | 362/240 |
| 2005/0264716 | A1 | 12/2005 | Kim et al. | |
| 2005/0281023 | A1 | 12/2005 | Gould | 362/217 |
| 2006/0221611 | A1 | 10/2006 | No | 362/247 |
| 2006/0245208 | A1 | 11/2006 | Sakamoto | |

(56) References Cited

U.S. PATENT DOCUMENTS

| | | | | |
|---|---|---|---|---|
| 2006/0262521 | A1 | 11/2006 | Piepgras et al. | 362/149 |
| 2006/0279671 | A1 | 12/2006 | Han | |
| 2006/0291206 | A1 | 12/2006 | Angelini et al. | 362/244 |
| 2007/0070625 | A1 | 3/2007 | Bang | 362/240 |
| 2007/0109779 | A1 | 5/2007 | Sekiguchi et al. | |
| 2007/0115670 | A1 | 5/2007 | Roberts et al. | |
| 2007/0115671 | A1 | 5/2007 | Roberts et al. | |
| 2007/0211457 | A1 | 9/2007 | Mayfield et al. | 362/223 |
| 2007/0217040 | A1 | 9/2007 | Suzuki et al. | |
| 2007/0253205 | A1 | 11/2007 | Welker | 362/373 |
| 2007/0279910 | A1 | 12/2007 | Lin | |
| 2007/0297181 | A1 | 12/2007 | Mayfield et al. | 362/342 |
| 2008/0019147 | A1 | 1/2008 | Erchak | 362/607 |
| 2008/0037284 | A1 | 2/2008 | Rudisill | 362/629 |
| 2008/0049422 | A1 | 2/2008 | Trenchard et al. | 362/238 |
| 2008/0232093 | A1 | 9/2008 | Kim | 362/147 |
| 2008/0278943 | A1 | 11/2008 | Van Der Poel | 362/240 |
| 2008/0303977 | A1 | 12/2008 | Sekiguchi | |
| 2009/0034247 | A1 | 2/2009 | Boyer | |
| 2009/0073693 | A1 | 3/2009 | Nall | 362/249.02 |
| 2009/0161356 | A1 | 6/2009 | Negley et al. | 362/231 |
| 2009/0168439 | A1 | 7/2009 | Chiang | 362/404 |
| 2009/0196024 | A1 | 8/2009 | Heiking et al. | 362/150 |
| 2009/0225543 | A1 | 9/2009 | Jacobson et al. | |
| 2009/0237958 | A1 | 9/2009 | Kim | |
| 2009/0262543 | A1 | 10/2009 | Ho | 362/373 |
| 2009/0296388 | A1 | 12/2009 | Wu et al. | 362/235 |
| 2009/0310354 | A1 | 12/2009 | Zampini et al. | 362/235 |
| 2009/0323334 | A1 | 12/2009 | Roberts et al. | |
| 2010/0039579 | A1 | 2/2010 | Park | |
| 2010/0061108 | A1 | 3/2010 | Zhang et al. | 362/364 |
| 2010/0097794 | A1 | 4/2010 | Teng et al. | 362/231 |
| 2010/0103678 | A1 | 4/2010 | Van de Ven et al. | 362/294 |
| 2010/0110679 | A1 | 5/2010 | Teng et al. | |
| 2010/0142202 | A1 | 6/2010 | Sugishita | |
| 2010/0172133 | A1 | 7/2010 | Lie | 362/235 |
| 2010/0177514 | A1 | 7/2010 | Liu et al. | |
| 2010/0177532 | A1 | 7/2010 | Simon et al. | 362/555 |
| 2010/0188609 | A1 | 7/2010 | Matsuki et al. | |
| 2010/0253591 | A1 | 10/2010 | Hwu et al. | 345/1.3 |
| 2010/0254128 | A1 | 10/2010 | Pickard et al. | 362/231 |
| 2010/0254145 | A1 | 10/2010 | Yamaguchi | |
| 2010/0254146 | A1 | 10/2010 | McCanless | |
| 2010/0270903 | A1 | 10/2010 | Jao et al. | 313/46 |
| 2010/0271816 | A1 | 10/2010 | Ozeki et al. | |
| 2010/0271843 | A1 | 10/2010 | Holten et al. | 362/609 |
| 2010/0277905 | A1 | 11/2010 | Janik et al. | 362/235 |
| 2010/0277934 | A1 | 11/2010 | Oquendo, Jr. | 362/433 |
| 2010/0277952 | A1 | 11/2010 | Chien | |
| 2010/0295468 | A1 | 11/2010 | Pedersen et al. | 315/294 |
| 2010/0302778 | A1 | 12/2010 | Dabiet | |
| 2010/0327768 | A1 | 12/2010 | Kong et al. | 315/294 |
| 2011/0032714 | A1 | 2/2011 | Chang | 362/373 |
| 2011/0043132 | A1 | 2/2011 | Kim et al. | 362/235 |
| 2011/0044023 | A1* | 2/2011 | Kim | F21S 8/026 362/84 |
| 2011/0051407 | A1 | 3/2011 | St. Ives et al. | |
| 2011/0090671 | A1 | 4/2011 | Bertram et al. | 362/84 |
| 2011/0141722 | A1 | 6/2011 | Acampora et al. | 362/218 |
| 2011/0141734 | A1 | 6/2011 | Li | 362/235 |
| 2011/0156584 | A1 | 6/2011 | Kim | 315/32 |
| 2011/0241734 | A1 | 6/2011 | Li et al. | 362/235 |
| 2011/0164417 | A1 | 7/2011 | Huang | 362/235 |
| 2011/0175533 | A1 | 7/2011 | Homan | 315/130 |
| 2011/0199005 | A1 | 8/2011 | Bretschneider et al. | |
| 2011/0199769 | A1 | 8/2011 | Bretschneider et al. | |
| 2011/0222291 | A1 | 9/2011 | Peng | |
| 2011/0246146 | A1 | 10/2011 | Kauffman et al. | 703/2 |
| 2011/0255292 | A1 | 10/2011 | Shen | 362/311 |
| 2011/0267810 | A1 | 11/2011 | Higman et al. | |
| 2011/0267823 | A1 | 11/2011 | Angelini et al. | |
| 2011/0286225 | A1 | 11/2011 | Konishi | |
| 2011/0305024 | A1 | 12/2011 | Chang | 362/294 |
| 2012/0033420 | A1 | 2/2012 | Kim et al. | 362/235 |
| 2012/0038289 | A1 | 2/2012 | Jee et al. | 315/291 |
| 2012/0051041 | A1 | 3/2012 | Edmond et al. | 362/231 |
| 2012/0120658 | A1 | 5/2012 | Wilk | |
| 2012/0127714 | A1 | 5/2012 | Rehn | |
| 2012/0134146 | A1 | 5/2012 | Smith | 362/225 |
| 2012/0140442 | A1 | 6/2012 | Woo | 362/95 |
| 2012/0140461 | A1 | 6/2012 | Huang et al. | |
| 2012/0206926 | A9 | 8/2012 | Chou | |
| 2012/0320576 | A1 | 12/2012 | Wald | |
| 2013/0235568 | A1 | 9/2013 | Green et al. | 362/218 |
| 2013/0242550 | A1 | 9/2013 | Suen | |
| 2013/0258652 | A1 | 10/2013 | Hsieh | 362/225 |
| 2014/0265930 | A1 | 9/2014 | Harris | 315/307 |
| 2015/0016100 | A1 | 1/2015 | Ishii | 362/223 |

FOREIGN PATENT DOCUMENTS

| | | | |
|---|---|---|---|
| CN | 1963289 | A | 5/2007 |
| CN | 101188261 | | 5/2008 |
| CN | 101550715 | | 3/2010 |
| CN | 101776254 | | 7/2010 |
| CN | 101776254 | A | 7/2010 |
| CN | 101790660 | | 7/2010 |
| CN | 101790660 | A | 7/2010 |
| CN | 102072443 | | 5/2011 |
| CN | 202580962 | | 12/2012 |
| DE | 102007030186 | | 1/2009 |
| DE | 102007030186 | A1 | 1/2009 |
| DE | 202010001832 | | 7/2010 |
| EP | 1298383 | | 4/2003 |
| EP | 1298383 | A2 | 4/2003 |
| EP | 1298383 | A2 | 4/2003 |
| EP | 1357335 | A2 | 10/2003 |
| EP | 165325 | | 3/2006 |
| EP | 1737051 | | 12/2006 |
| EP | 1847762 | | 10/2007 |
| EP | 1847762 | A2 | 10/2007 |
| EP | 1847762 | A2 | 10/2007 |
| EP | 1860467 | | 11/2007 |
| EP | 2287520 | A2 | 2/2011 |
| EP | 2290690 | A2 | 3/2011 |
| EP | 2636945 | A2 | 9/2013 |
| GB | 774198 | | 5/1957 |
| JP | 1069869 | | 3/1998 |
| JP | 2002244037 | | 11/2002 |
| JP | U3097327 | | 8/2003 |
| JP | 2004140327 | | 5/2004 |
| JP | 2004345615 | | 12/2004 |
| JP | 2004345615 | A | 12/2004 |
| JP | 2006173624 | | 6/2006 |
| JP | 2008147044 | | 6/2008 |
| JP | 3151501 | U | 6/2009 |
| JP | 2009295577 | | 12/2009 |
| JP | 2010103687 | | 5/2010 |
| JP | 2011018571 | | 8/2011 |
| JP | 2011018572 | | 8/2011 |
| TW | 200524186 | | 7/2005 |
| TW | 200524186 | A | 7/2005 |
| TW | 200914759 | A | 4/2009 |
| TW | 201018826 | | 5/2010 |
| TW | 201018826 | A | 5/2010 |
| WO | WO03102467 | | 12/2003 |
| WO | WO2009030233 | | 3/2009 |
| WO | WO2009140761 | A1 | 11/2009 |
| WO | WO2009157999 | | 12/2009 |
| WO | WO2009157999 | A | 12/2009 |
| WO | WO2009157999 | A1 | 12/2009 |
| WO | WO2010024583 | | 3/2010 |
| WO | WO2010024583 | A2 | 3/2010 |
| WO | WO2010042216 | | 4/2010 |
| WO | WO2010042216 | A2 | 4/2010 |
| WO | WO2011074424 | A1 | 6/2011 |
| WO | WO2011096098 | A1 | 8/2011 |
| WO | WO2011098191 | | 8/2011 |
| WO | WO2011118991 | A2 | 9/2011 |

(56) References Cited

FOREIGN PATENT DOCUMENTS

| | | |
|---|---|---|
| WO | WO2011140353 A2 | 11/2011 |
| WO | WO03102467 | 12/2013 |

OTHER PUBLICATIONS

Examination Report from Taiwan Application No. 100131021; dated Jul. 21, 2016.
Office Action for U.S. Appl. No. 13/828,348; dated Jun. 2, 2016.
Notice of Reason for Rejection for Japanese Appl. No. 2013-543207, dated May 24, 2016.
Office Action from U.S. Appl. No. 15/464,745; dated Mar. 1, 2016.
Office Action from U.S. Appl. No. 14/716,480; dated Mar. 3, 2016.
Office Action from U.S. Appl. No. 13/268,217; dated Mar. 4, 2016.
Office Action from U.S. Appl. No. 13/189,535; dated Mar. 18, 2016.
Office Action from U.S. Appl. No. 14/020,757; dated Apr. 7, 2016.
Office Action from U.S. Appl. No. 29/166,391; dated May 10, 2016.
Second Office Action for Application No. 2011800588770; dated Mar. 29, 2016.
Examination Report from Taiwanese Patent Appl. No. 100131021, dated Jan. 5, 2016.
Examination from European Patent Appl. No. 12743003.1-1757, dated Jan. 8, 2016.
Notice of Reasons for Rejection from Japanese Patent Appl. No. 2013-543207, dated Feb. 2, 2016.
Examination from European Patent Appl. No. 13 701 525.1-1757, dated Feb. 3, 2016.
Office Action from U.S. Appl. No. 13/189,535; dated Jan. 6, 2016.
Office Action from U.S. Appl. No. 13/341,741; dated Jan. 8, 2016.
Office Action from U.S. Appl. No. 12/961,385, dated Nov. 27, 2015.
Office Action from U.S. Appl. No. 13/020,318, dated Nov. 4, 2015.
Office Action from U.S. Appl. No. 14/020,757, dated Nov. 24, 2014.
First Office Action from Chinese Patent Appl. No. 2011800588770, dated Sep. 25, 2015.
Office Action from U.S. Appl. No. 13/429,080, dated Sep. 1, 2015.
Office Action from U.S. Appl. No. 14/716,480, dated Sep. 24, 2015.
Office Action from U.S. Appl. No. 14/170,627, dated Oct. 5, 2015.
Office Action from U.S. Appl. No. 13/368,217, dated Oct. 8, 2015.
Office Action from U.S. Appl. No. 13/464,745, dated Oct. 8, 2015.
Office Action from U.S. Appl. No. 29/466,391, dated Oct. 14, 2015.
Decision of Rejection from Chinese Patent Appl. No. 201180052998.4, dated Jul. 16, 2015.
Notice of Completion of Pretrial Re-examination from Japanese Patent appl. No. 2013-543207, dated Jun. 30, 2015.
Pretrial Report from Japanese Appl. No. 2013-543207, dated Jun. 19, 2015.
Office Action from U.S. Appl. No. 13/341,741, dated Jun. 22, 2015.
Office Action from U.S. Appl. No. 13/443,630, dated Jun. 23, 2015.
Response to OA from U.S. Appl. No. 13/443,630, filed Aug. 21, 2015.
Office Action from U.S. Appl. No. 13/189,535, dated Jul. 14, 2015.
Office Action from U.S. Appl. No. 13/453,924, dated Jul. 21, 2015.
Office Action from U.S. Appl. No. 13/442,746, dated Jul. 27, 2015.
Office Action from U.S. Appl. No. 14/020,757, dated Aug. 3, 2015.
First Office Action from Chinese Patent Appl. No. 2012800369142, dated Mar. 26, 2015.
Office Action from U.S. Appl. No. 13/464,745, dated Apr. 2, 1015.
Office Action from U.S. Appl. No. 13/442,746, dated Apr. 28, 2015.
Office Action from U.S. Appl. No. 13/368,217, dated May 13, 2015.
Office Action from U.S. Appl. No. 13/828,348, dated May 27, 2015.
Office Action from U.S. Appl. No. 13/787,727, dated Jan. 29, 2015.
Office Action from U.S. Appl. No. 13/429,080, dated Feb. 18, 2015.
Office Action from U.S. Appl. No. 13/453,924, dated Mar. 10, 2015.
First Official Action from European Patent Appl. No. 12 743 033.1-1757, dated Jan. 16, 2015.
Second Office Action and Search Report from Chinese Appl. No. 2011800529984, dated Dec. 26, 2014.
Grant Notice from European Appl. No. 13701525.1, dated Nov. 19, 2014.
International Report and Written Opinion from PCT/US2013/049225, dated Jan. 22, 2015.
Office Action from U.S. Appl. No. 13/828,348, dated Nov. 20, 2014.
Office Action from U.S. Appl. No. 13/464,745, dated Dec. 10, 2014.
Office Action from U.S. Appl. No. 13/341,741, dated Dec. 24, 2014.
Office Action from U.S. Appl. No. 13/189,535, dated Jan. 13, 2015.
Decision of Rejection from Japanese Appl. No. 2013-543207, dated Nov. 25, 2014.
Office Action from Mexican Appl. No. 100881, dated Nov. 28, 2014.
Grant Notice from European Appl. No. 13701525.1-1757, dated Nov. 24, 2014.
Preliminary Report on Patentability from PCT/US2013/035668, dated Oct. 14, 2014.
Office Action from U.S. Appl. No. 13/442,746, dated Sep. 15, 2014.
Office Action from U.S. Appl. No. 12/429,080, dated Sep. 16, 2014.
Office Action from U.S. Appl. No. 13/844,431, dated Oct. 10, 2014.
Office Action from U.S. Appl. No. 13/443,630, dated Oct. 10, 2014.
Office Action from U.S. Appl. No. 13/368,217, dated Oct. 22, 2014.
Office Action from U.S. Appl. No. 12/961,385, dated Nov. 6, 2014.
Office Action from U.S. Appl. No. 11/453,924, dated Nov. 7, 2014.
Communication from European Patent Appl. No. 13701520.1-1757, dated Sep. 26, 2014.
Office Action from U.S. Appl. No. 13/464,745, dated Jul. 16, 2014.
International Preliminary Report on Patentability and Written Opinion from PCT/US2013/021051, dated Aug. 21, 2014.
International Preliminary Report on Patentabiliby from PCT/US2012/071800 dated Jul. 10, 2014.
Office Action from U.S. Appl. No. 13/189,535, dated Jun. 20, 2014.
Office Action from U.S. Appl. No. 13/453,924, dated Jun. 25, 2014.
Office Action from U.S. Appl. No. 13/443,630, dated Jul. 1, 2014.
First Office Action from Chinese Patent Appl. No. 2011800529984, dated May 4, 2014.
Reasons for Rejction from Japanese Patent Appl. No. 2013-543207, dated May 20, 2014.
Office Action from U.S. Appl. No. 13/544,662, dated May 5, 2014.
Office Action from U.S. Appl. No. 13/844,431, dated May 15, 2014.
Office Action from U.S. Appl. No. 13/341,741, dated Jun. 6, 2014.
Oifice Action from U.S. Appl. No. 13/429,080, dated Apr. 18, 2014.
Office Action from U.S. Appl. No. 12/961,385, dated Mar. 11, 2014.
Preliminary Report and Written Opinion from PCT appl. No. PCT/US2012/047084, dated Feb. 6, 2014.
Office Action from U.S. Appl. No. 13/464,745, dated Feb. 12, 2014.
Office Action from U.S. Appl. No. 13/453,924, dated Feb. 19, 2014.
Office Action from U.S. Appl. No. 13/341,741, dated Jan. 14, 2014.
Office Action from U.S. Appl. No. 13/370,252, dated Dec. 20, 2013.
International Search Report and Written Opinion from Appl. No. PCT/CN2013/072772, dated Dec. 19, 2013.
International Search Report and Written Opinion from PCT/US2013/049225, dated Oct. 24, 2013.
Office Action from U.S. Appl. No. 29/387,271, dated May 2, 2012.
Response to OA from U.S. Appl. No. 29/387,171, filed Aug. 2, 2012.
Office Action from U.S. Appl. No. 12/961,385, dated Apr. 26, 2013.
Response to OA from U.S. Appl. No. 12/961,385, filed Jul. 24, 2013.
Office Action from U.S. Appl. No. 13/464,745, dated Jul. 16, 2013.
Office Action from U.S. Appl. No. 29/368,970, dated Jun. 19, 2012.
Office Action from U.S. Appl. No. 29/368,970, dated Aug. 24, 2012.
Response to OA from U.S. Appl. No. 29/368,970, filed Nov. 26, 2012.
Final Rejection issued in Korean Design Appl. No. 30-2011-0038114, dated Jun. 14, 2013.
Final Rejection issued in Korean Design Appl. No. 30-2011-0038115, dated Jun. 14, 2013.
Final Rejection issued in Korean Design Appl. No. 30-2011-0038116, dated Jun. 17, 2013.
International Search Report and Written Opinion from PCT Patent Appl. No. PCT/US2013/035668, dated Jul. 12, 2013.
International Search Report and Written Opinion from PCT Applicaton No. PCT/US2013/021053, dated Apr. 17, 2013.
Search Report and Written Opinion from PCT Patent Appl. No. PCT/US2012/047084, dated Feb. 27, 2013.

(56) References Cited

OTHER PUBLICATIONS

Search Report and Written Opinion from PCT Patent Appl. No. PCT/US2012/071800, dated Mar. 25, 2013.
Notice to Submit a Response from Korean Patent Application No. 30-2011-0038115, dated Dec. 12, 2012.
Notice to Submit a Response from Korean Patent Application No. 30-2011-0038116, dated Dec. 12, 2012.
International Search Report and Written Opinion for PCT Application No. PCT/US2011/062395, dated Jul. 13, 2012.
Office Action from Japanese Design Patent Application No. 2011-18570.
Reason for Rejection from Japanese Design Patent Application No. 2011-18571.
Reason for Rejection from Japanese Design Patent Application No. 2011-18572.
International Search Report and Written Opinion for Patent Application No. PCT/US2011/001517, dated Feb. 27, 2012.
Office Action for U.S. Appl. No. 13/189,535; dated Apr. 5, 2018.
Office Action for U.S. Appl. No. 14/225,327; dated Apr. 19, 2018.
Office Action for U.S. Appl. No. 13/464,745; dated May 2, 2018.
Foreign Office Action for European Application No. 11754767.9; dated May 7, 2018.
Office Action for U.S. Appl. No. 13/464,745; dated Dec. 11, 2017.
Office Action for U.S. Appl. No. 14/716,480; dated Jan. 17, 2018.
Office Action for U.S. Appl. No. 14/225,327; dated Oct. 2, 2017.
Office Action for U.S. Appl. No. 13/189,535; dated Oct. 30, 2017.
Office Action for U.S. Appl. No. 14/721,806; dated Nov. 1, 2017.
Office Action for U.S. Appl. No. 14/170,627; dated Nov. 29, 2017.
Office Action for U.S. Appl. No. 14/716,480; dated Feb. 8, 2017.
Foreign Office Action for Japanese Application No. 2013-543207; dated Feb. 14, 2017.
Office Action for U.S. Appl. No. 14/225,327; dated Mar. 14, 2017.
European Notice of Allowance for Application No. 12743003.1; dated Mar. 17, 2017.
Office Action for U.S. Appl. No. 13/189,535; dated Mar. 23, 2017.
Office Action for U.S. Appl. No. 13/464,745; dated Mar. 23, 2017.
Office Action for U.S. Appl. No. 14/721,806; dated Apr. 21, 2017.
Office Action for U.S. Appl. No. 13/443,630; dated May 18, 2017.
Foreign Office Action for Chinese Application No. 2011800529984; dated Apr. 5, 2017.
Office Action for U.S. Appl. No. 12/873,303; dated Nov. 25, 2016.
Notice of Allowance for Taiwan Application No. 100131021; dated Nov. 28, 2016.
Office Action for European Application No. 11754767.9; dated Oct. 31, 2016.
Notification of Reexamination for Chinese Application No. 2011800529984; dated Oct. 10, 2016.
Office Action for U.S. Appl. No. 13/828,348; dated Oct. 17, 2016.
Office Action for U.S. Appl. No. 13/368,217; dated Jan. 3, 2017.
Office Action for U.S. Appl. No. 14/020,757; dated Jul. 19, 2016.
Office Action for U.S. Appl. No. 14/716,480; dated Aug. 26, 2016.
European Summons for Oral Proceedings for Application No. 12743003.1; dated Sep. 2, 2016.
Office Action for U.S. Appl. No. 13/464,745; dated Sep. 7, 2016.
Non-Final Office Action for U.S. Appl. No. 12/873,303, dated Nov. 28, 2014, 23 pages.
Final Office Action for U.S. Appl. No. 12/873,303, dated Jun. 22, 2015, 26 pages.
Non-Final Office Action for U.S. Appl. No. 12/873,303, dated Feb. 2, 2016, 29 pages.
Non-Final Office Action for U.S. Appl. No. 12/873,303, dated Aug. 9, 2017, 35 pages.
Final Office Action for U.S. Appl. No. 12/873,303, dated Jun. 19, 2018, 32 pages.
Non-Final Office Action for U.S. Appl. No. 12/873,303, dated Jun. 3, 2019, 35 pages.
Final Office Action for U.S. Appl. No. 12/873,303, dated Feb. 11, 2020, 33 pages.
Non-Final Office Action for U.S. Appl. No. 12/873,303, dated Jul. 24, 2020, 8 pages.
Notice of Allowance for U.S. Appl. No. 12/873,303, dated Sep. 29, 2020, 9 pages.
Extended European Search Report for European Patent Application No. 20214719.5, dated Feb. 24, 2021, 9 pages.
International Preliminary Report on Patentability for International Patent Application No. PCT/US2011/001517, dated Mar. 14, 2013, 11 pages.
Non-Final Office Action for U.S. Appl. No. 17/032,252, dated Feb. 18, 2021, 10 pages.
Notice of Allowance for U.S. Appl. No. 17/032,252, dated Aug. 24, 2021, 8 pages.

* cited by examiner

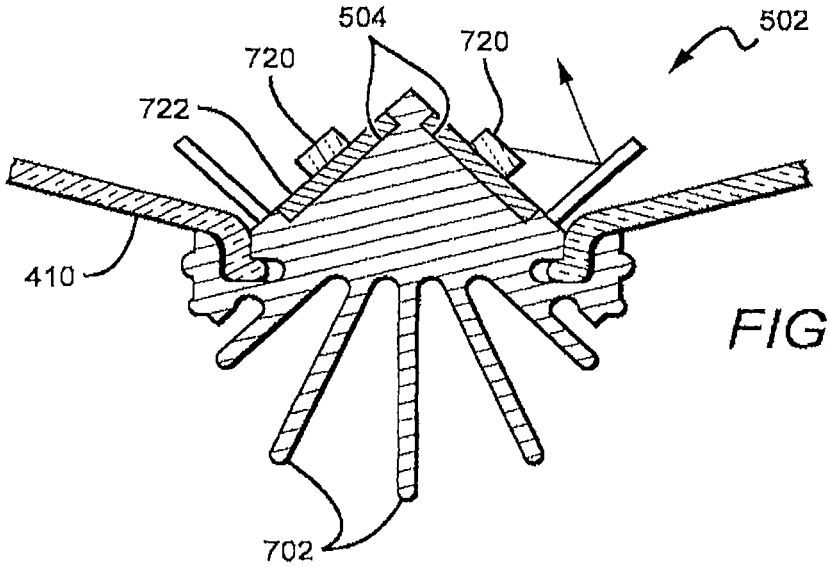
FIG. 7b
FIG. 8a
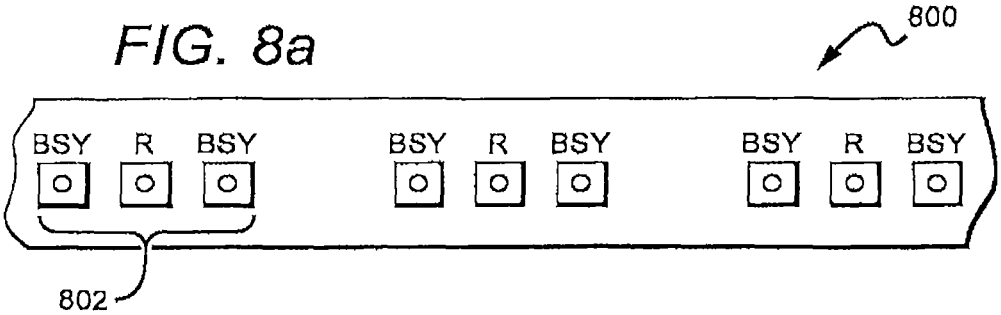
FIG. 8b
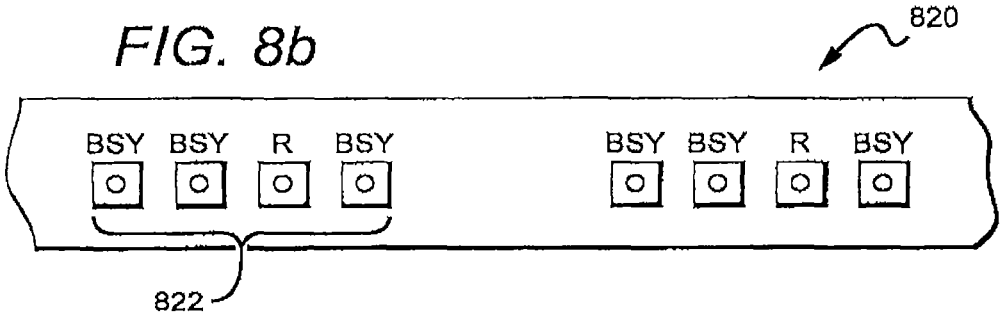
FIG. 8c
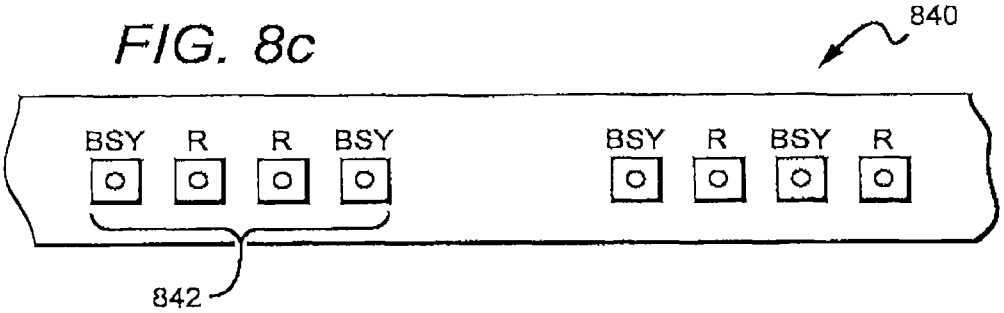

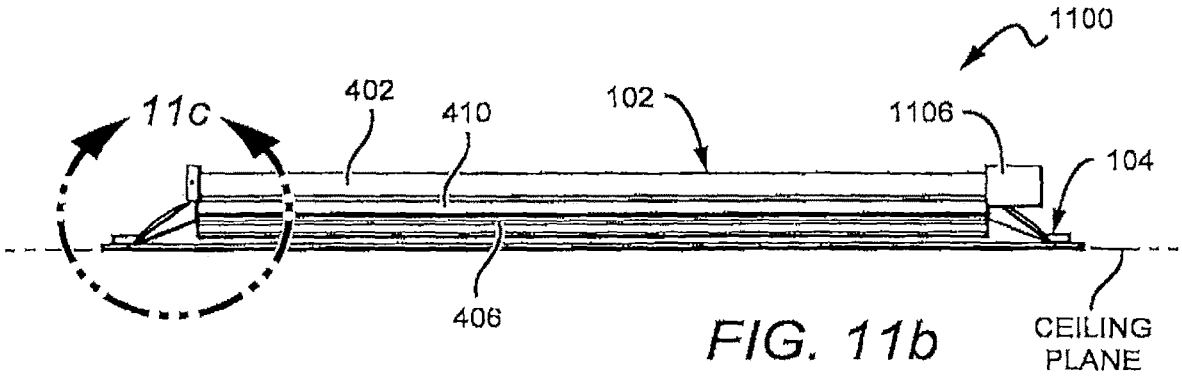
FIG. 11b
FIG. 11c
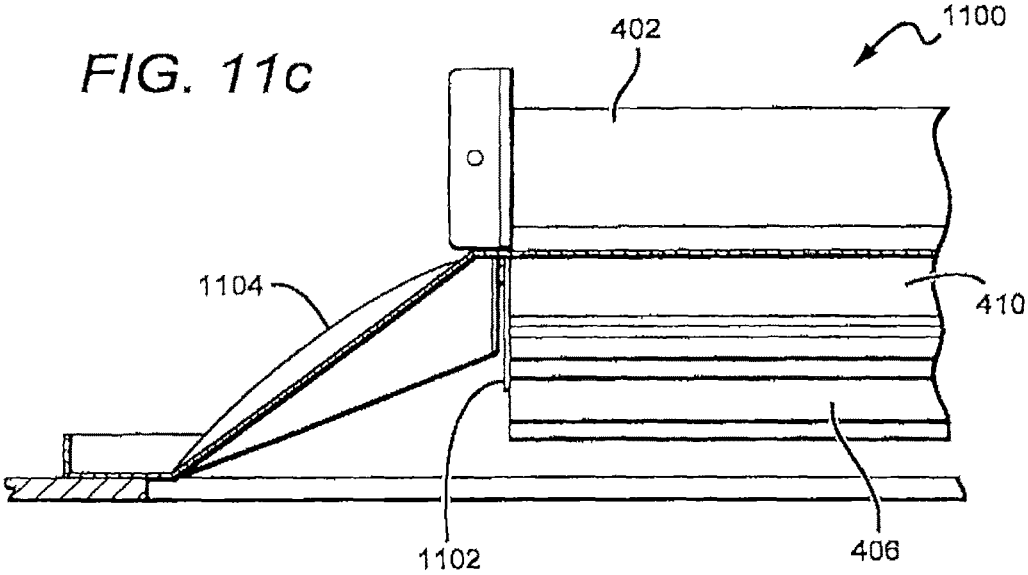
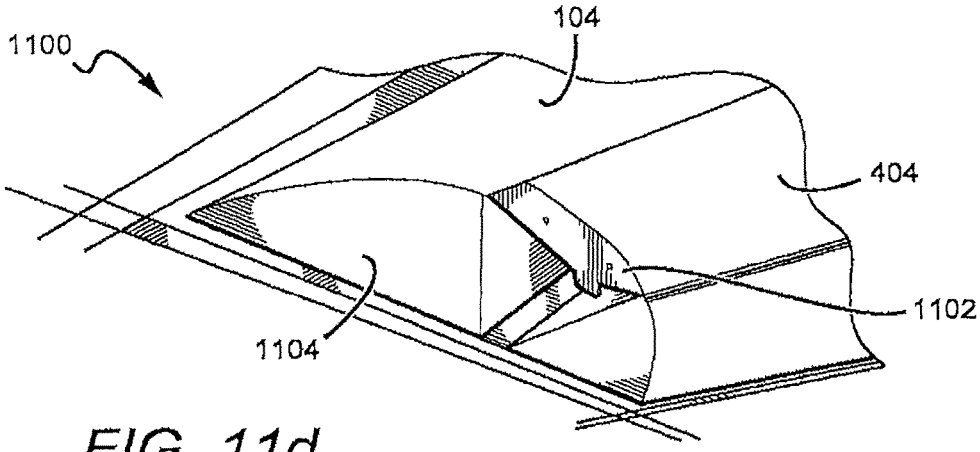
FIG. 11d

TROFFER-STYLE FIXTURE

RELATED APPLICATIONS

The present application is a continuation of U.S. patent application Ser. No. 12/873,303, filed Aug. 31, 2010, now U.S. Pat. No. 10,883,702, which is incorporated herein by reference in its entirety.

BACKGROUND OF THE INVENTION

Field of the Invention

The invention relates to lighting troffers and, more particularly, to indirect lighting troffers that are well-suited for use with solid state lighting sources, such as light emitting diodes (LEDs).

Description of the Related Art

Troffer-style fixtures are ubiquitous in commercial office and industrial spaces throughout the world. In many instances these troffers house elongated fluorescent light bulbs that span the length of the troffer. Troffers may be mounted to or suspended from ceilings. Often the troffer may be recessed into the ceiling, with the back side of the troffer protruding into the plenum area above the ceiling. Typically, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al. are examples of typical troffer-style fixtures.

More recently, with the advent of the efficient solid state lighting sources, these troffers have been used with LEDs, for example. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in their LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

Other LED components or lamps have been developed that comprise an array of multiple LED packages mounted to a (PCB), substrate or submount. The array of LED packages can comprise groups of LED packages emitting different colors, and specular reflector systems to reflect light emitted by the LED chips. Some of these LED components are arranged to produce a white light combination of the light emitted by the different LED chips.

In order to generate a desired output color, it is sometimes necessary to mix colors of light which are more easily produced using common semiconductor systems. Of particular interest is the generation of white light for use in everyday lighting applications. Conventional LEDs cannot generate white light from their active layers; it must be produced from a combination of other colors. For example, blue emitting LEDs have been used to generate white light by surrounding the blue LED with a yellow phosphor, polymer or dye, with a typical phosphor being cerium-doped yttrium aluminum garnet (Ce:YAG). The surrounding phosphor material "downconverts" some of the blue light, changing it to yellow light. Some of the blue light passes through the phosphor without being changed while a substantial portion of the light is downconverted to yellow. The LED emits both blue and yellow light, which combine to yield white light.

In another known approach, light from a violet or ultraviolet emitting LED has been converted to white light by surrounding the LED with multicolor phosphors or dyes. Indeed, many other color combinations have been used to generate white light.

Because of the physical arrangement of the various source elements, multicolor sources often cast shadows with color separation and provide an output with poor color uniformity. For example, a source featuring blue and yellow sources may appear to have a blue tint when viewed head on and a yellow tint when viewed from the side. Thus, one challenge associated with multicolor light sources is good spatial color mixing over the entire range of viewing angles. One known approach to the problem of color mixing is to use a diffuser to scatter light from the various sources.

Another known method to improve color mixing is to reflect or bounce the light off of several surfaces before it is emitted from the lamp. This has the effect of disassociating the emitted light from its initial emission angle. Uniformity typically improves with an increasing number of bounces, but each bounce has an associated optical loss. Some applications use intermediate diffusion mechanisms (e.g., formed diffusers and textured lenses) to mix the various colors of light. Many of these devices are lossy and, thus, improve the color uniformity at the expense of the optical efficiency of the device.

Many current luminaire designs utilize forward-facing LED components with a specular reflector disposed behind the LEDs. One design challenge associated with multi-source luminaires is blending the light from LED sources within the luminaire so that the individual sources are not visible to an observer. Heavily diffusive elements are also used to mix the color spectra from the various sources to achieve a uniform output color profile. To blend the sources and aid in color mixing, heavily diffusive exit windows have been used. However, transmission through such heavily diffusive materials causes significant optical loss.

Some recent designs have incorporated an indirect lighting scheme in which the LEDs or other sources are aimed in a direction other than the intended emission direction. This may be done to encourage the light to interact with internal elements, such as diffusers, for example. One example of an indirect fixture can be found in U.S. Pat. No. 7,722,220 to Van de Ven which is commonly assigned with the present application.

Modern lighting applications often demand high power LEDs for increased brightness. High power LEDs can draw large currents, generating significant amounts of heat that must be managed. Many systems utilize heat sinks which must be in good thermal contact with the heat-generating light sources. Troffer-style fixtures generally dissipate heat from the back side of the fixture that extends into the plenum. This can present challenges as plenum space decreases in modern structures. Furthermore, the temperature in the plenum area is often several degrees warmer than the room environment below the ceiling, making it more difficult for the heat to escape into the plenum ambient.

SUMMARY OF THE INVENTION

One embodiment of a light engine unit comprises the following elements. A body comprises a back reflector on a surface of the body. A heat sink is mounted proximate to the back reflector. The heat sink comprises a mount surface that faces toward the back reflector. The mount surface is capable of having at least one light emitter mounted thereto. The region between the heat sink and the body defines an interior cavity.

A lighting troffer according to an embodiment of the present invention comprises the following elements. A pan structure comprises an inner reflective surface. A body is mounted inside the pan structure such that the inner reflective surface surrounds the body. A back reflector is disposed on a surface of the body. An elongated heat sink is mounted proximate to the back reflector and runs longitudinally along a central region of the body. A plurality of light emitting diodes (LEDs) are disposed on a mount surface of the heat sink that faces toward the back reflector. Lens plates are arranged on each side of the heat sink and extend from the heat sink to the back reflector such that the back reflector, the heat sink, and the lens plates define an interior cavity.

A lighting unit according to an embodiment of the present invention comprises the following elements. A back reflector comprises a spine region that runs longitudinally down the back reflector and a first side region on a side of the spine region. A heat sink is mounted proximate to the back reflector, the heat sink comprising a mount surface that faces toward the back reflector. The region between the heat sink and the body defines an interior cavity. A plurality of light emitters is disposed on the mount surface and aimed to emit light toward the back reflector.

BRIEF DESCRIPTION OF THE DRAWINGS

FIG. 7*b* is a close-up view of a heat sink according to an embodiment of the present invention.

FIG. 8*a* is a top plan view of a light strip according to an embodiment of the present invention.

FIG. 8*b* is a top plan view of a light strip according to an embodiment of the present invention.

FIG. 8*c* is a top plan view of a light strip.

FIG. 11*b* is a side view of a portion of a troffer along cutaway line 11*b*-11*b* shown in FIG. 11*a*.

FIG. 11*c* is a close-up of a portion denoted in FIG. 11*b* of a troffer according to an embodiment of the present invention.

FIG. 11*d* is a perspective view of a portion of a troffer according to an embodiment of the present invention.

DETAILED DESCRIPTION OF THE INVENTION

Figure 1:
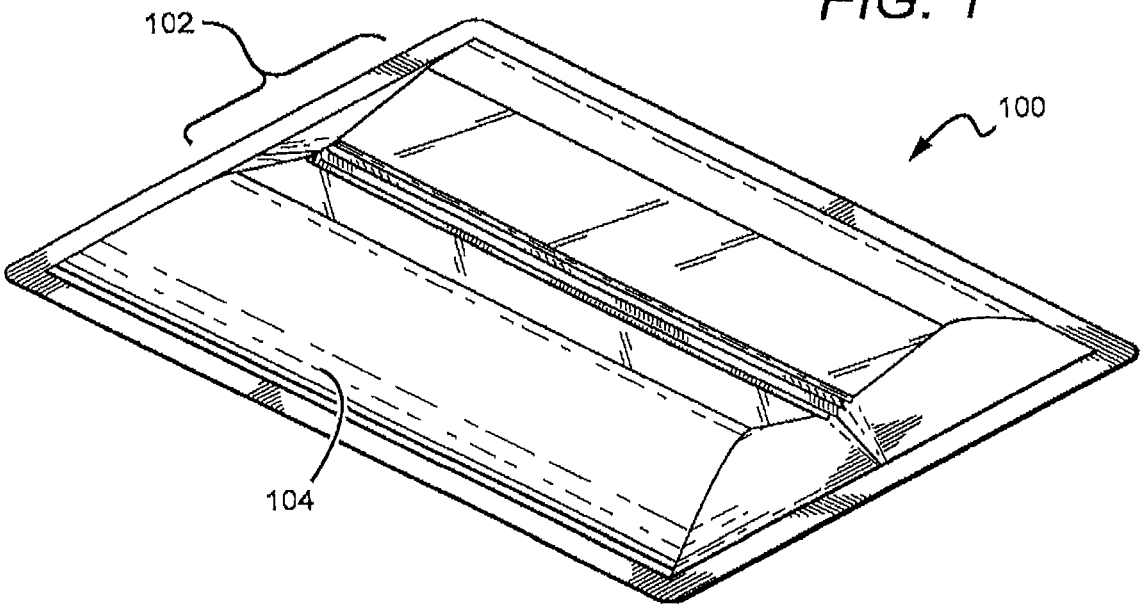
FIG. 1 is a perspective view from the bottom side of a troffer according to an embodiment of the present invention.

Embodiments of the present invention provide a troffer-style fixture that is particularly well-suited for use with solid state light sources, such as LEDs. The troffer comprises a light engine unit that is surrounded on its perimeter by a reflective pan. A back reflector defines a reflective surface of the light engine. To facilitate the dissipation of unwanted thermal energy away from the light sources, a heat sink is disposed proximate to the back reflector. In some embodiments, one or more lens plates extend from the heat sink out to the back reflector. An interior cavity is at least partially defined by the back reflector, the lens plates, and the heat sink. A portion of the heat sink is exposed to the ambient environment outside of the cavity. The portion of the heat sink inside the cavity functions as a mount surface for the light sources, creating an efficient thermal path from the sources to the ambient. One or more light sources disposed along the heat sink mount surface emit light into the interior cavity where it can be mixed and/or shaped before it is emitted from the troffer as useful light.

Because LED sources are relatively intense when compared to other light sources, they can create an uncomfortable working environment if not properly diffused. Fluorescent lamps using T8 bulbs typically have a surface luminance of around 21 lm/in$^2$. Many high output LED fixtures currently have a surface luminance of around 32 lm/in$^2$. Some embodiments of the present invention are designed to provide a surface luminance of not more than approximately 32 lm/in$^2$. Other embodiments are designed to provide a surface luminance of not more than approximately 21 lm/in$^2$. Still other embodiments are designed to provide a surface luminance of not more than approximately 12 lm/in$^2$.

Some fluorescent fixtures have a depth of 6 in., although in many modern applications the fixture depth has been reduced to around 5 in. In order to fit into a maximum number of existing ceiling designs, some embodiments of the present invention are designed to have a fixture depth of 5 in or less.

Embodiments of the present invention are designed to efficiently produce a visually pleasing output. Some embodiments are designed to emit with an efficacy of no less than approximately 65 lm/W. Other embodiments are designed to have a luminous efficacy of no less than approximately 76 lm/W. Still other embodiments are designed to have a luminous efficacy of no less than approximately 90 lm/W.

One embodiment of a recessed lay-in fixture for installation into a ceiling space of not less than approximately 4 ft$^2$ is designed to achieve at least 88% total optical efficiency with a maximum surface luminance of not more than 32 lm/in$^2$ with a maximum luminance gradient of not more than 5:1. Total optical efficiency is defined as the percentage of light emitted from the light source(s) that is actually emitted from the fixture. Other similar embodiments are designed to achieve a maximum surface luminance of not more than 24 lm/in$^2$. Still other similar embodiments are designed to achieve a maximum luminance gradient of not more than 3:1. In these embodiments, the actual room-side area profile of the fixture will be approximately 4 ft$^2$ or greater due to the fact that the fixture must fit inside a ceiling opening having an area of at least 4 ft$^2$ (e.g., a 2 ft by 2 ft opening, a 1 ft by 4 ft opening, etc.).

Embodiments of the present invention are described herein with reference to conversion materials, wavelength conversion materials, phosphors, phosphor layers and related terms. The use of these terms should not be construed as limiting. It is understood that the use of the term phosphor, or phosphor layers is meant to encompass and be equally applicable to all wavelength conversion materials.

It is understood that when an element is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "source" can be used to indicate a single light emitter or more than one light emitter functioning as a single source. For example, the term may be used to describe a single blue LED, or it may be used to describe a red LED and a green LED in proximity emitting as a single source. Thus, the term "source" should not be construed as a limitation indicating either a single-element or a multi-element configuration unless clearly stated otherwise.

The term "color" as used herein with reference to light is meant to describe light having a characteristic average wavelength; it is not meant to limit the light to a single wavelength. Thus, light of a particular color (e.g., green, red, blue, yellow, etc.) includes a range of wavelengths that are grouped around a particular average wavelength.

Embodiments of the invention are described herein with reference to cross-sectional view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the invention.

FIG. 1 is a perspective view from the bottom side of a troffer 100 according to an embodiment of the present invention. The troffer 100 comprises a light engine unit 102 which fits within a reflective pan 104 that surrounds the perimeter of the light engine 102. The light engine 102 and the pan 104 are discussed in detail herein. The troffer 100 may be suspended or fit-mounted within a ceiling. The view of the troffer 100 in FIG. 1 is from an area underneath the troffer 100, i.e., the area that would be lit by the light sources housed within the troffer 100.

Figure 2:
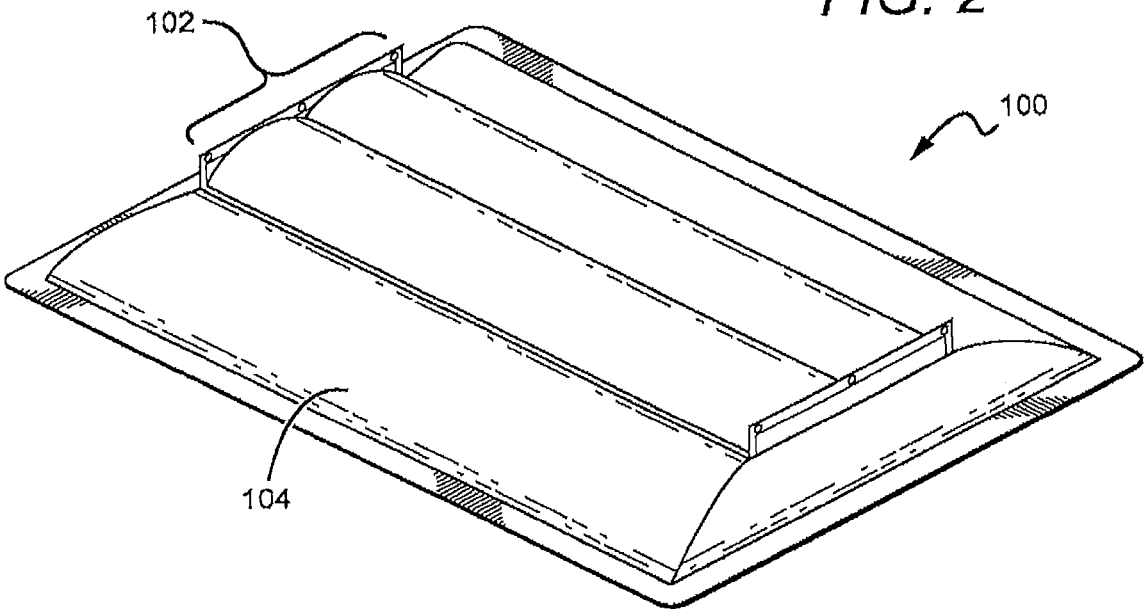
FIG. 2 is a perspective view from the top side of a troffer according to an embodiment of the present invention.

FIG. 2 is a perspective view from the top side of the troffer 100. The troffer may be mounted in a ceiling such that the edge of the pan 104 is flush with the ceiling plane. In this configuration the top portion of the troffer 100 would protrude into the plenum above the ceiling. The troffer 100 is designed to have a reduced height profile, so that the back end only extends a small distance (e.g., 4.25-5 in) into the plenum. In other embodiments, the troffer can extend larger distances into the plenum.

Figure 3:
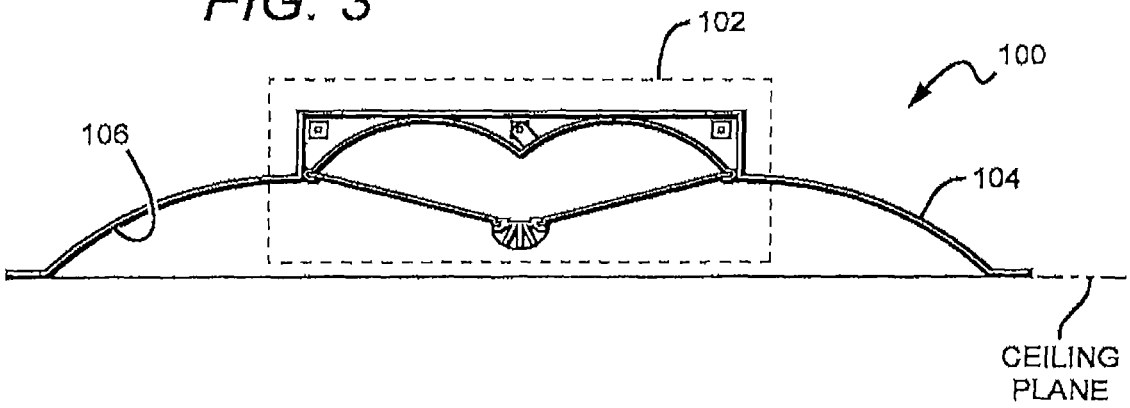
FIG. 3 is a cross-sectional view of a troffer according to an embodiment of the present invention.

FIG. 3 is a cross-sectional view of the troffer 100. As shown, the light engine 102 is mounted to fit within the pan 104. In this embodiment, the bottom edge of the pan 104 is mounted such that it is flush with the ceiling plane. Only the reflective bottom surface 106 of the pan 104 is shown. It is understood that the top portion of the pan 104 may take any shape necessary to achieve a particular profile so long as the pan 104 provides sufficient to support the light engine 102.

Figure 4:
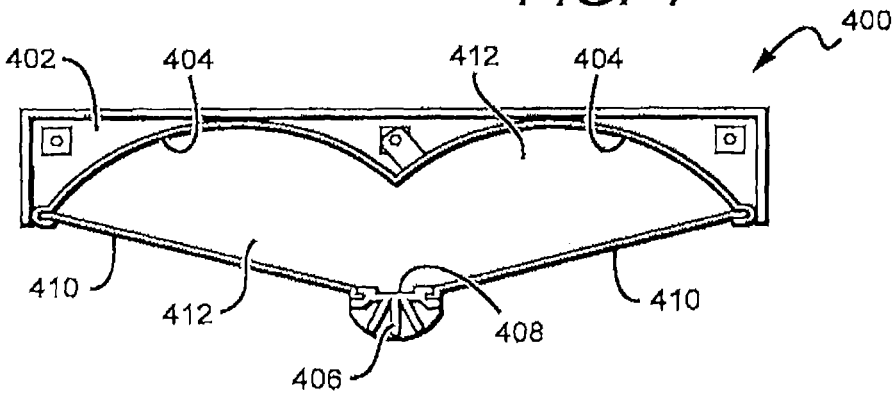
FIG. 4 is a cross-sectional view of a light engine unit according to an embodiment of the present invention.

FIG. 4 is a cross-sectional view of a light engine unit 400 according to an embodiment of the present invention: A body 402 is shaped to define an interior surface comprising a back reflector 404. A heat sink 406 is mounted proximate to the back reflector 404. The heat sink comprises a mount surface 408 that faces toward the back reflector 404. The mount surface 408 provides a substantially flat area where light sources (not shown) can be mounted to face toward the center region of the back reflector 404, although the light sources could be angled to face other portions of the back reflector 404. In this embodiment, lens plates 410 extend from both sides of the heat sink 408 to the bottom edge of the body 402. The back reflector 404, heat sink 406, and lens plates 410 at least partially define an interior cavity 412. In some embodiments, the light sources may be mounted to a mount, such as a metal core board, FR4 board, printed circuit board, or a metal strip, such as aluminum, which can then be mounted to a separate heat sink, for example using thermal paste, adhesive and/or screws. In some embodiments, a separate heat sink is not used, or a heat sink or path is used without fins.

Figure 5:
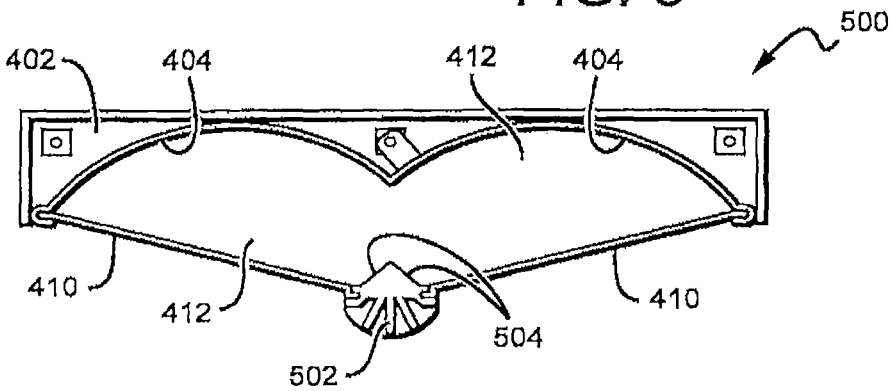
FIG. 5 is a cross-sectional view of a light engine unit according to an embodiment of the present invention.

FIG. 5 is a cross-sectional view a light engine unit 500 according to an embodiment of the present invention. The light engine 500 shares several common elements with the light engine 400. For convenience, like elements will retain the same reference numerals throughout the specification. This embodiment comprises a heat sink 502 having a mount surface 504 that is bent to provide two substantially flat areas to which lights sources (not shown) can be mounted. The light sources can be mounted flat to the surface 504 to face the side regions of the back reflector 404 such that they emit peak intensity in a direction orthogonal to the mount surface 504, or the sources can be aimed to emit in another direction.

With continued reference to FIGS. 4 and 5, the back reflector 404 may be designed to have several different shapes to perform particular optical functions, such as color mixing and beam shaping, for example. The back reflector 404 should be highly reflective in the wavelength ranges of the light sources. In some embodiments, the back reflector 404 may be 93% reflective or higher. In other embodiments the reflective layer may be at least 95% reflective or at least 97% reflective.

The back reflector 404 may comprise many different materials. For many indoor lighting applications, it is desirable to present a uniform, soft light source without unpleasant glare, color striping, or hot spots. Thus, the back reflector 404 may comprise a diffuse white reflector such as a microcellular polyethylene terephthalate (MCPET) material or a Dupont/WhiteOptics material, for example. Other white diffuse reflective materials can also be used.

Diffuse reflective coatings have the inherent capability to mix light from solid state light sources having different spectra (i.e., different colors). These coatings are particularly well-suited for multi-source designs where two different spectra are mixed to produce a desired output color point. For example, LEDs emitting blue light may be used in combination with LEDs emitting yellow (or blue-shifted yellow) light to yield a white light output. A diffuse reflective coating may eliminate the need for additional spatial color-mixing schemes that can introduce lossy elements into the system; although, in some embodiments it may be desirable to use a diffuse back reflector in combination with other diffusive elements. In some embodiments, the back reflector is coated with a phosphor material that converts the wavelength of at least some of the light from the light emitting diodes to achieve a light output of the desired color point.

By using a diffuse white reflective material for the back reflector 404 and by positioning the light sources to emit first toward the back reflector 404 several design goals are achieved. For example, the back reflector 404 performs a color-mixing function, effectively doubling the mixing distance and greatly increasing the surface area of the source. Additionally, the surface luminance is modified from bright, uncomfortable point sources to a much larger, softer diffuse reflection. A diffuse white material also provides a uniform luminous appearance in the output. Harsh surface luminance gradients (max/min ratios of 10:1 or greater) that would typically require significant effort and heavy diffusers to ameliorate in a traditional direct view optic can be managed with much less aggressive (and lower light loss) diffusers achieving max/min ratios of 5:1, 3:1, or even 2:1.

The back reflector 404 can comprise materials other than diffuse reflectors. In other embodiments, the back reflector 404 can comprise a specular reflective material or a material that is partially diffuse reflective and partially specular reflective. In some embodiments, it may be desirable to use a specular material in one area and a diffuse material in another area. For example, a semi-specular material may be used on the center region with a diffuse material used in the side regions to give a more directional reflection to the sides. Many combinations are possible.

In accordance with certain embodiments of the present invention, the back reflector 404 can comprise subregions that extend from the elongated or linear array of light emitting diodes in symmetrical fashion along the length of the array. In certain embodiments each of the subregions uses the same or symmetrical shape on either side of the elongated or linear array of light emitting diodes. In some embodiments, additional subregions could be positioned relative to either end of the elongated or linear array of light emitting diodes. In other embodiments, depending on the desired light output pattern, the back reflector subregions can have asymmetrical shape(s).

Figure 6A:
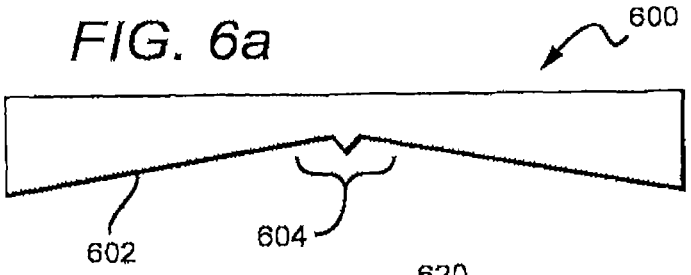
FIG. 6*a* is a cross-sectional view of a back reflector according to an embodiment of the present invention.
Figure 6B:
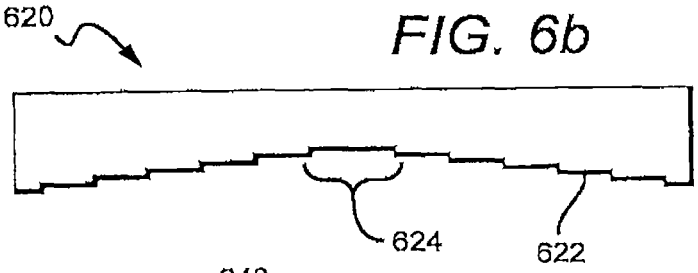
FIG. 6*b* is a cross-sectional view of a back reflector according to an embodiment of the present invention.
Figure 6C:
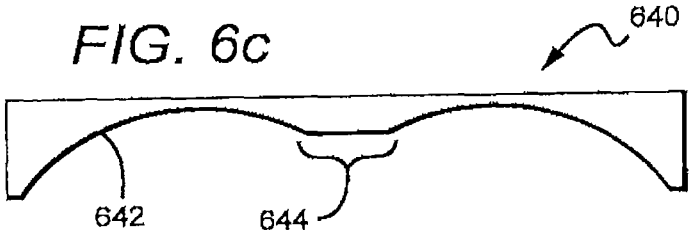
FIG. 6*c* is a cross-sectional view of a back reflector according to an embodiment of the present invention.
Figure 6D:
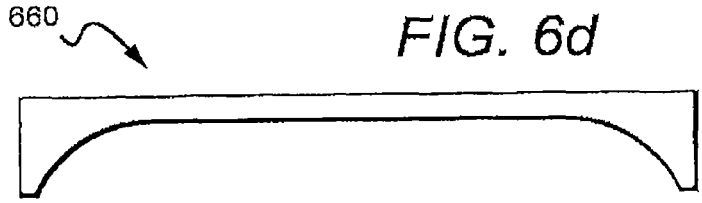
FIG. 6*d* is a cross-sectional view of a back reflector according to an embodiment of the present invention.

The back reflector 404 in the light engine units 400, 500 include side regions 412 having a parabolic shape; however, many other shapes are possible. FIGS. 6*a-c* are cross-sectional views of various shapes of back reflectors. The back section 600 of FIG. 6*a* features flat side regions 602 and a center region 604 defined by a vertex, similarly as back reflector 404. FIG. 6*b* features corrugated or stair-step side regions 622 and a flat center region 624. The step size and the distance between steps can vary depending on the intended output profile. In some embodiments the corrugation may be implemented on a microscopic scale. FIG. 6*c* shows a back reflector 640 having parabolic side regions 642 and a flat center region 644. FIG. 6*d* shows a back reflector 660 having a curvilinear contour. It is understood that geometries of the back reflectors 600, 620, 640, 660 are exemplary, and that many other shapes and combinations of shapes are possible. The shape of the back reflector should be chosen to produce the appropriate reflective profile for an intended output.

Figure 7A:
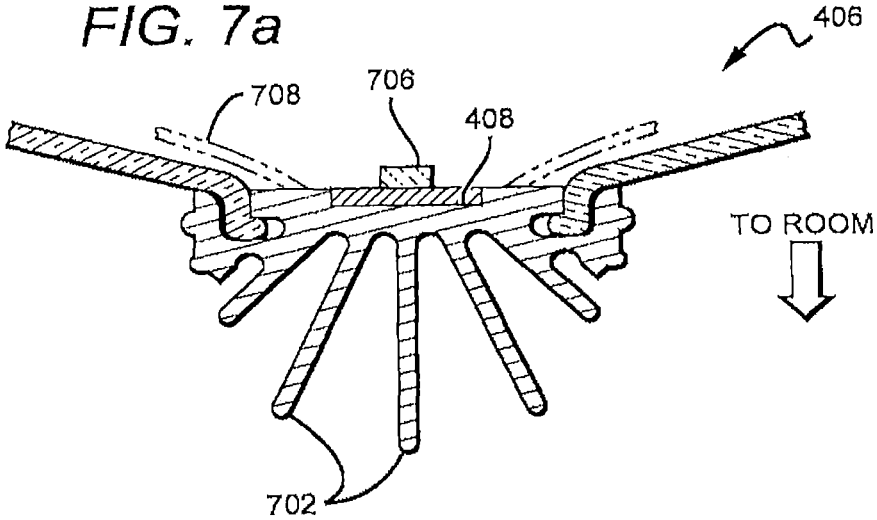
FIG. 7*a* is a close-up view of a heat sink according to an embodiment of the present invention.

FIG. 7*a* is a close-up cross-sectional view of the heat sink 406. The heat sink 406 comprises fin structures 702 on the bottom side (i.e., the room side). Although it is understood that many different heat sink structures may be used. The top side portion of the heat sink 406 which faces the interior cavity comprises a mount surface 704. The mount surface 704 provides a substantially flat area on which light sources 706 such as LEDs, for example, can be mounted. The sources 706 can be mounted to face orthogonally to the mount surface 704 to face the center region of the back reflector, or they may be angled to face other portions of the back reflector. In some embodiments, an optional baffle 708 (shown in phantom) may be included. The baffle 708 reduces the amount of light emitted from the sources 706 at high angles that escapes the cavity without being properly mixed. This prevents visible hot spots or color spots at high viewing angles.

FIG. 7*b* is a close-up cross-sectional view of the heat sink 502. As shown above with reference to FIG. 5, the mount surface 504 may comprise multiple flat areas on which light sources can be mounted. Angled surfaces provide an easy way to aim multiple light sources 720 that come pre-mounted on a light strip 722, for example. In this embodiment, a baffle 724 is included on the mounting surface to redirect light emitted at high angles from the sources 720 toward the back reflectors.

A typical solid state lighting fixture will incorporate a heat sink that sits above the ceiling plane to dissipate conducted LED heat into the environment. Temperatures above office and industrial ceilings in a non-plenum ceiling regularly reach 35° C. As best shown in the perspective view of FIG. 9, discussed herein, the bottom portion of the heat sink 406, including the fin structures 706, are exposed to the air in the room beneath the troffer.

The exposed heat sink 406 is advantageous for several reasons. For example, air temperature in a typical office room is much cooler than the air above the ceiling, obviously because the room environment must be comfortable for occupants; whereas in the space above the ceiling, cooler air temperatures are much less important. Additionally, room air is normally circulated, either by occupants moving through the room or by air conditioning. The movement of air throughout the room helps to break the boundary layer, facilitating thermal dissipation from the heat sink 404. Also, a room-side heat sink configuration prevents improper installation of insulation on top of the heat sink as is possible with typical solid state lighting applications in which the heat sink is disposed on the ceiling-side. This guard against improper installation can eliminate a potential fire hazard.

The mount surface 704 provides a substantially flat area on which one or more light sources 706 can be mounted. In some embodiments, the light sources 706 will be pre-mounted on light strips. FIGS. 8*a-c* show a top plan view of portions of several light strips 800, 820, 840 that may be used to mount multiple LEDs to the mount surface 704. Although LEDs are used as the light sources in various embodiments described herein, it is understood that other light sources, such as laser diodes for example, may be substituted in as the light sources in other embodiments of the present invention.

Many industrial, commercial, and residential applications call for white light sources. The troffer 100 may comprise one or more emitters producing the same color of light or different colors of light. In one embodiment, a multicolor source is used to produce white light. Several colored light combinations will yield white light. For example, it is known in the art to combine light from a blue LED with wavelength-converted yellow (blue-shifted-yellow or "BSY") light to yield white light with correlated color temperature (CCT) in the range between 5000K to 7000K (often designated as "cool white"). Both blue and BSY light can be generated with a blue emitter by surrounding the emitter with phosphors that are optically responsive to the blue light. When excited, the phosphors emit yellow light which then combines with the blue light to make white. In this scheme, because the blue light is emitted in a narrow spectral range it is called saturated light. The BSY light is emitted in a much broader spectral range and, thus, is called unsaturated light.

Another example of generating white light with a multicolor source is combining the light from green and red LEDs. RGB schemes may also be used to generate various colors of light. In some applications, an amber emitter is added for an RGBA combination. The previous combinations are exemplary; it is understood that many different color combinations may be used in embodiments of the present invention. Several of these possible color combinations are discussed in detail in U.S. Pat. No. 7,213,940 to Van de Ven et al.

The lighting strips 800, 820, 840 each represent possible LED combinations that result in an output spectrum that can be mixed to generate white light. Each lighting strip can include the electronics and interconnections necessary to power the LEDs. In some embodiments the lighting strip comprises a printed circuit board with the LEDs mounted and interconnected thereon. The lighting strip 800 includes clusters 802 of discrete LEDs, with each LED within the cluster 802 spaced a distance from the next LED, and each cluster 802 spaced a distance from the next cluster 802. If the LEDs within a cluster are spaced at too great distance from one another, the colors of the individual sources may become visible, causing unwanted color-striping. In some embodiments, an acceptable range of distances for separating consecutive LEDs within a cluster is not more than approximately 8 mm.

The scheme shown in FIG. 8*a* uses a series of clusters 802 having two blue-shifted-yellow LEDs ("BSY") and a single red LED ("R"). Once properly mixed the resultant output light will have a "warm white" appearance.

The lighting strip 820 includes clusters 822 of discrete LEDs. The scheme shown in FIG. 8*b* uses a series of clusters 822 having three BSY LEDs and a single red LED. This scheme will also yield a warm white output when sufficiently mixed.

The lighting strip 840 includes clusters 842 of discrete LEDs. The scheme shown in FIG. 8*c* uses a series of clusters 842 having two BSY LEDs and two red LEDs. This scheme will also yield a warm white output when sufficiently mixed.

The lighting schemes shown in FIGS. 8*a-c* are meant to be exemplary. Thus, it is understood that many different LED combinations can be used in concert with known conversion techniques to generate a desired output light color.

Figure 9:
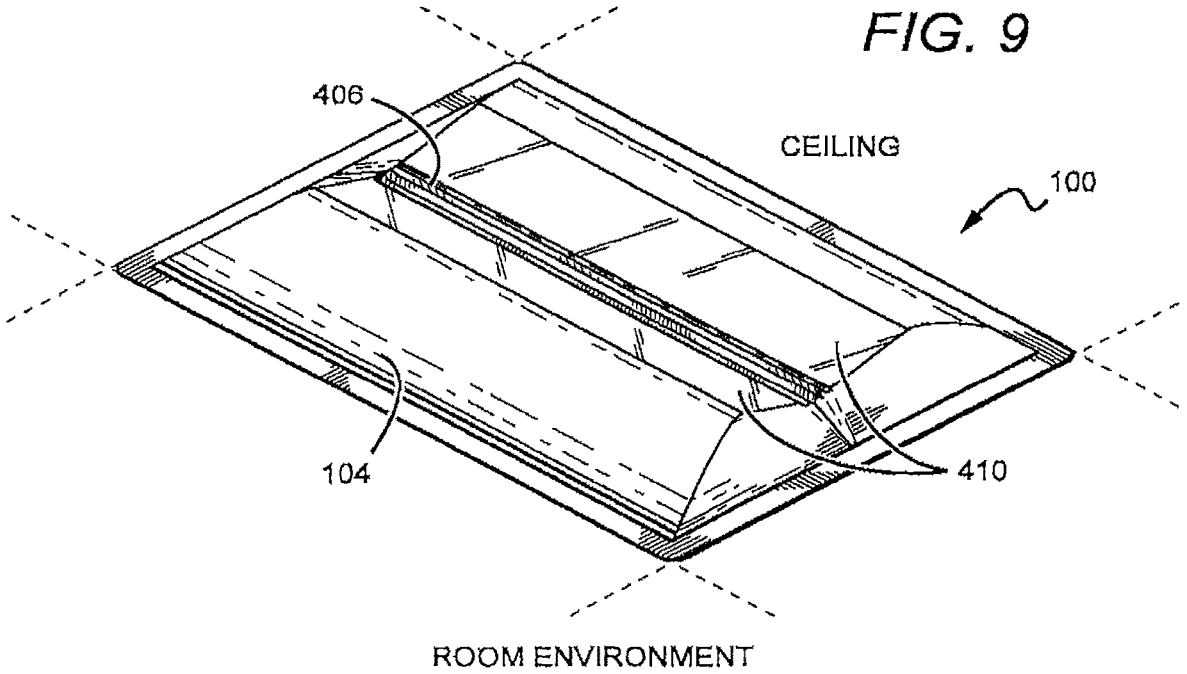
FIG. 9 is a perspective view from the room-side of a troffer according to an embodiment of the present invention installed in a typical office ceiling.

FIG. 9 shows a perspective view of the troffer 100 installed in a typical office ceiling. In this view the back reflector is occluded from view by the lens plates 410 and the heat sink 406. As discussed, the bottom side of the heat sink 406 is exposed to the room environment. In this embodiment, the heat sink 406 runs longitudinally along the center of the troffer 100 from end to end. The reflective pan 104 is sized to fit around the light engine unit 102. High angle light that is emitted from the light engine 102 is redirected into the room environment by the reflective surfaces of the pan 104.

This particular embodiment of the troffer 100 comprises lens plates 410 extending from the heat sink 406 to the edge of the light engine body. The lens plates 410 can comprise many different elements and materials.

In one embodiment, the lens plates 410 comprise a diffusive element. Diffusive lens plates function in several ways. For example, they can prevent direct visibility of the sources and provide additional mixing of the outgoing light to achieve a visually pleasing uniform source. However, a diffusive lens plate can introduce additional optical loss into the system. Thus, in embodiments where the light is sufficiently mixed by the back reflector or by other elements, a diffusive lens plate may be unnecessary. In such embodiments, a transparent glass lens plate may be used, or the lens plates may be removed entirely. In still other embodiments, scattering particles may be included in the lens plates 410. In embodiments using a specular back reflector, it may be desirable to use a diffuse lens plate. Diffusive elements in the lens plates 410 can be achieved with several different structures. A diffusive film inlay can be applied to the top- or bottom-side surface of the lens plates 410. It is also possible to manufacture the lens plates 410 to include an integral diffusive layer, such as by coextruding the two materials or insert molding the diffuser onto the exterior or interior surface. A clear lens may include a diffractive or repeated geometric pattern rolled into an extrusion or molded into the surface at the time of manufacture. In another embodiment, the lens plate material itself may comprise a volumetric diffuser, such as an added colorant or particles having a different index of refraction, for example.

In other embodiments, the lens plates 410 may be used to optically shape the outgoing beam with the use of microlens structures, for example. Many different kinds of beam shaping optical features can be included integrally with the lens plates 410.

Figure 10:
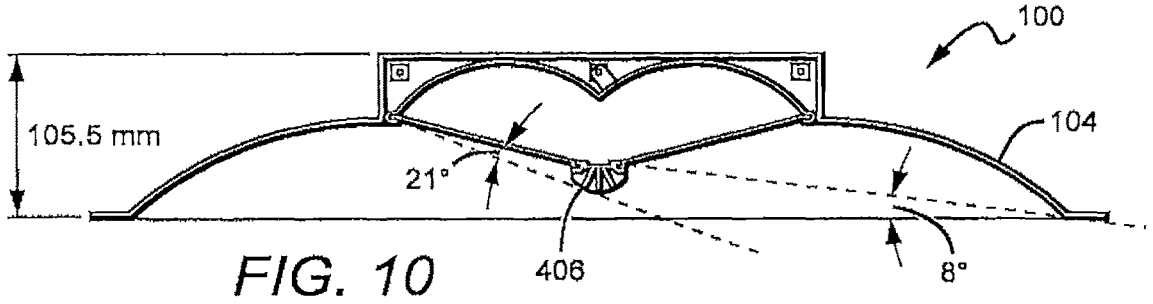
FIG. 10 is a cross-sectional view of a troffer according to an embodiment of the present invention.

FIG. 10 is a cross-sectional view of the troffer 100 according to one embodiment of the present invention. In this particular embodiment, the total depth of the troffer 100 is approximately 105.5 mm, or less than 4.25 in.

Because lighting fixtures are traditionally used in large areas populated with modular furniture, such as in an office for example, many fixtures can be seen from anywhere in the room. Specification grade fixtures often include mechanical shielding in order to effectively hide the light source from the observer once he is a certain distance from the fixture, providing a "quiet ceiling" and a more comfortable work environment.

Because human eyes are sensitive to light contrast, it is generally desirable to provide a gradual reveal of the brightness from the troffer 100 as an individual walks through a lighted room. One way to ensure a gradual reveal is to use the surfaces of the troffer 100 to provide mechanical cutoff. Using these surfaces, the mechanical structure of the troffer 100 provides built-in glare control. In the troffer 100, the primary cutoff is 8° due to the edge of the pan 104. However, only 50% of the lens plate 410 area is visible between the viewing angles of 8° and 21°. This is because the heat sink 406 also provides mechanical shielding. The troffer 100 structure allows the position of the heat sink 406 to be adjusted to provide the desired level of shielding without the constraint of thermal surface area requirements.

Figure 11A:
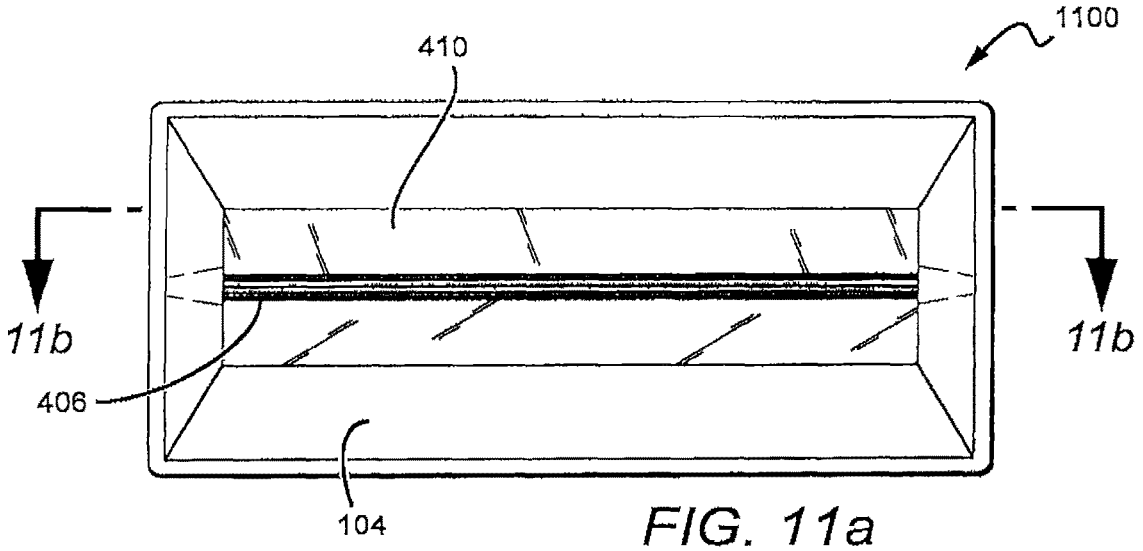
FIG. 11*a* is a bottom plan view of a troffer according to an embodiment of the present invention.

FIG. 11*a* is a bottom plan view of a troffer 1100 according to an embodiment of the present invention. FIG. 11*b* is a side view along the cutaway line shown in FIG. 11*a* of a portion the troffer 1100. FIG. 11*c* is a close-up view of a portion of the troffer 1100 as denoted in FIG. 11*b*. FIG. 11*d* is a perspective view of the troffer 1100 from the room-side. The lens plates and heat sink elements have been removed from this view to reveal the end cap 1102 and contoured pan end piece 1104 configuration. The troffer 1100 comprises many similar elements as the troffer 100 as indicated by the reference numerals. This particular embodiment comprises opaque end caps 1102 (best shown in FIG. 11*d*) and contoured pan end pieces 1104. The end caps 1102 close the longitudinal ends of the interior cavity between the light engine 102 and the pan 104. The pan end pieces 1104 are contoured to substantially match the shape of the end caps 1102. The contoured structure of the end pieces 1104 prevents a shadow from being cast onto the pan 104 when the light sources are operating.

A circuit box 1106 may be attached to the back side of the light engine 102. The circuit box 1106 can house electronic components used to drive and control the light sources such as rectifiers, regulators, timing circuitry, and other elements.

Figure 12A:
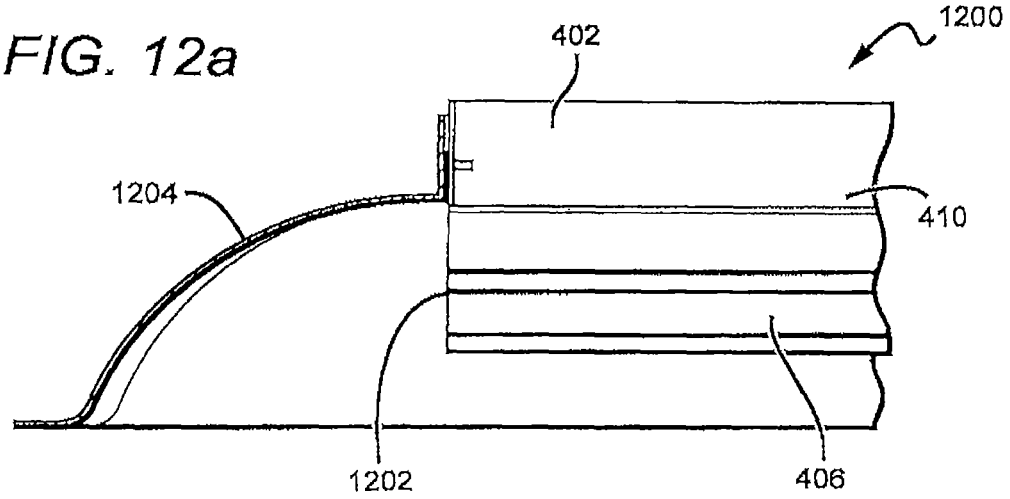
FIG. 12*a* is a close-up cross-sectional view of a portion of a troffer according to an embodiment of the present invention.
Figure 12B:
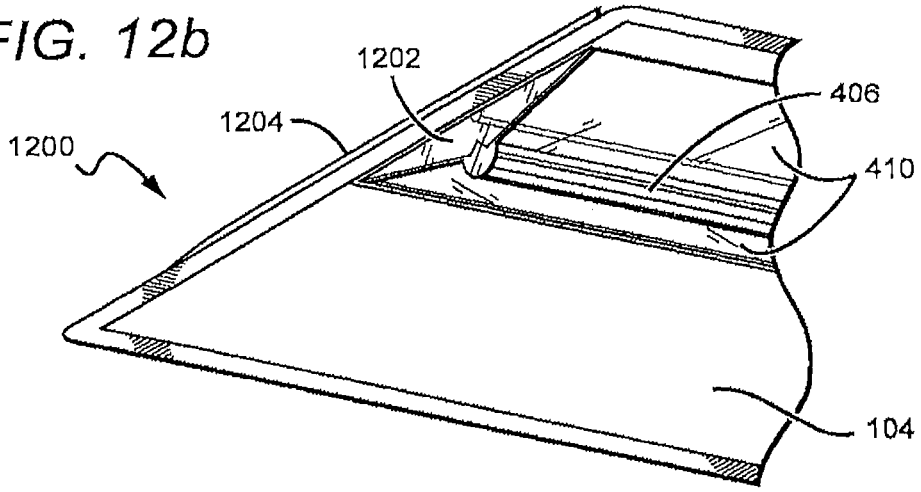
FIG. 12*b* is a perspective view of a portion of a troffer according to an embodiment of the present invention.

FIG. 12*a* is a cross-sectional view of a portion of a troffer 1200 according to an embodiment of the present invention. FIG. 12*b* is a perspective view of a portion of the troffer 1200. In contrast to troffer 1100, the troffer 1200 comprises transmissive (i.e., transparent or translucent) end caps 1202 disposed at both longitudinal ends of the light engine. The transmissive end caps 1202 allow light to pass from the ends of the cavity to the end piece 1204 of the pan structure 104. Because light passes through them, the end caps 1202 help to reduce the shadows that are cast on the pan when the light sources are operational. The end pieces 1204 of the pan may be contoured to redirect the high-angle light that is transmitted through the end caps 1202 to produce a particular output beam profile.

Figure 13:
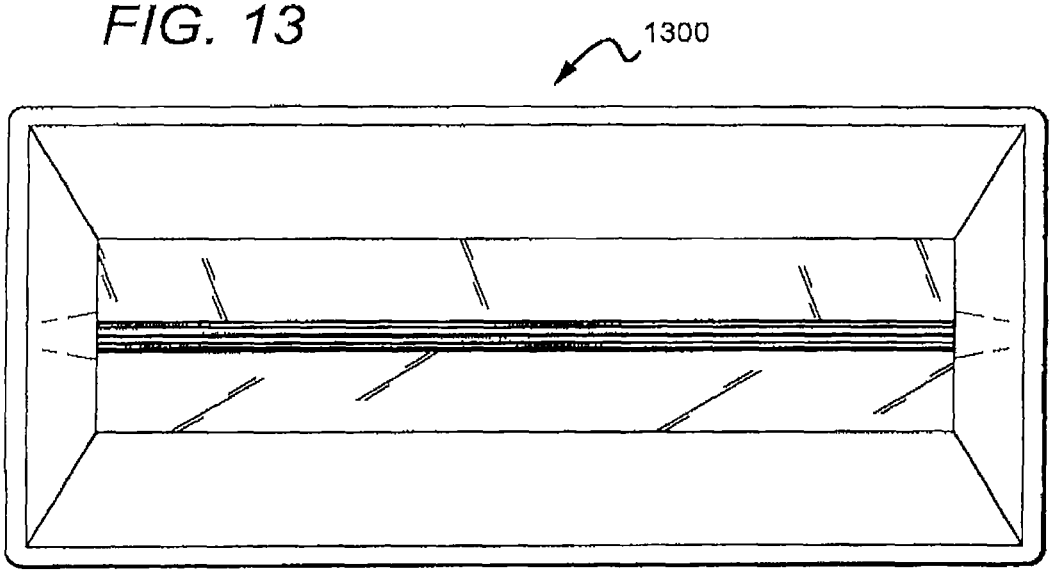
FIG. 13 is a bottom plan view of a troffer according to an embodiment of the present invention.
Figure 14:
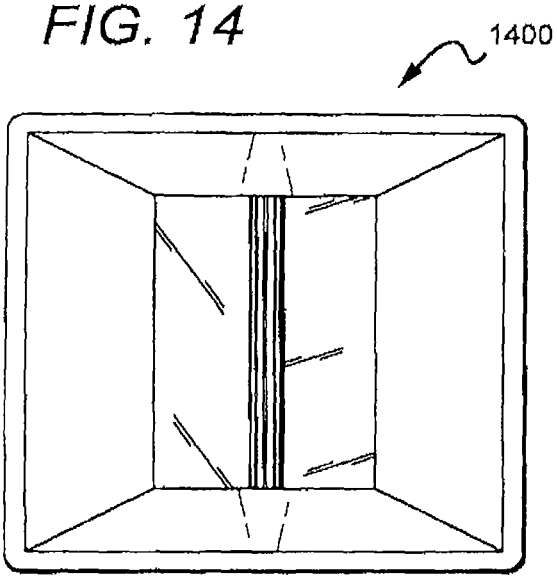
FIG. 14 is a bottom plan view of a troffer according to an embodiment of the present invention.
Figure 15:
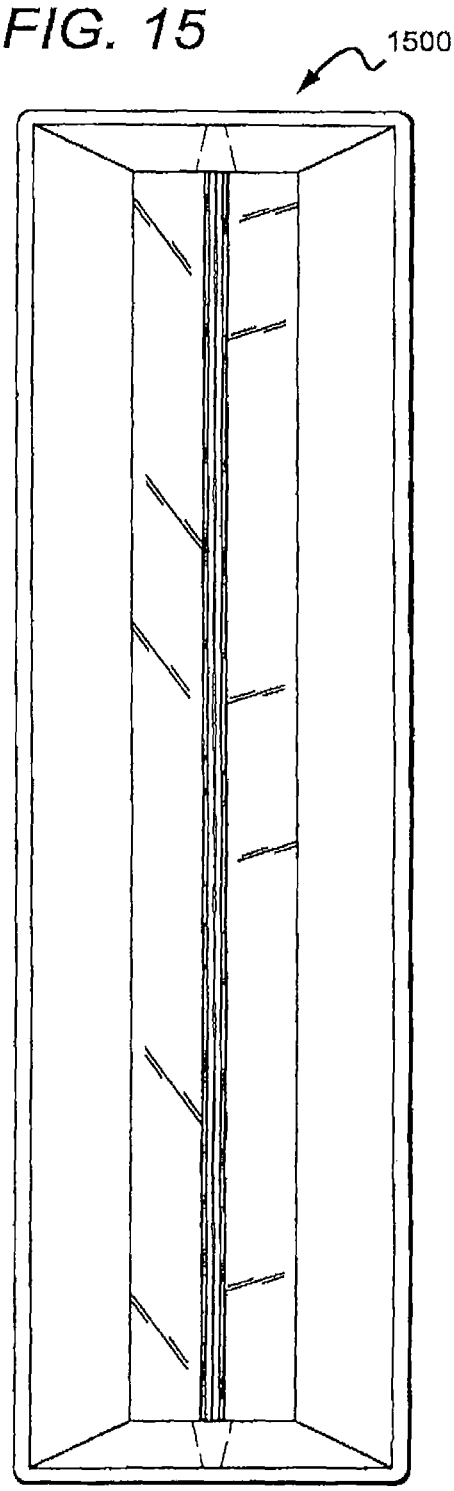
FIG. 15 is a bottom plan view of a troffer according to an embodiment of the present invention.

Troffers according to embodiments of the present invention can have many different sizes and aspect ratios. FIG. 13 is a bottom plan view of a troffer 1300 according to an embodiment of the present invention. This particular troffer 1300 has an aspect ratio (length to width) of 2:1. FIG. 14 is a bottom plan view of another troffer 1400 according to an embodiment of the present invention. The troffer 1400 has square dimensions. That is, the length and the width of the troffer 1400 are the same. FIG. 15 is a bottom plan view of yet another troffer 1500 according to another embodiment of the present invention. The troffer 1500 has an aspect ratio of 4:1. It is understood that troffers 1300, 1400, 1500 are exemplary embodiments, and the disclosure should not be limited to any particular size or aspect ratio.

Figure 16:
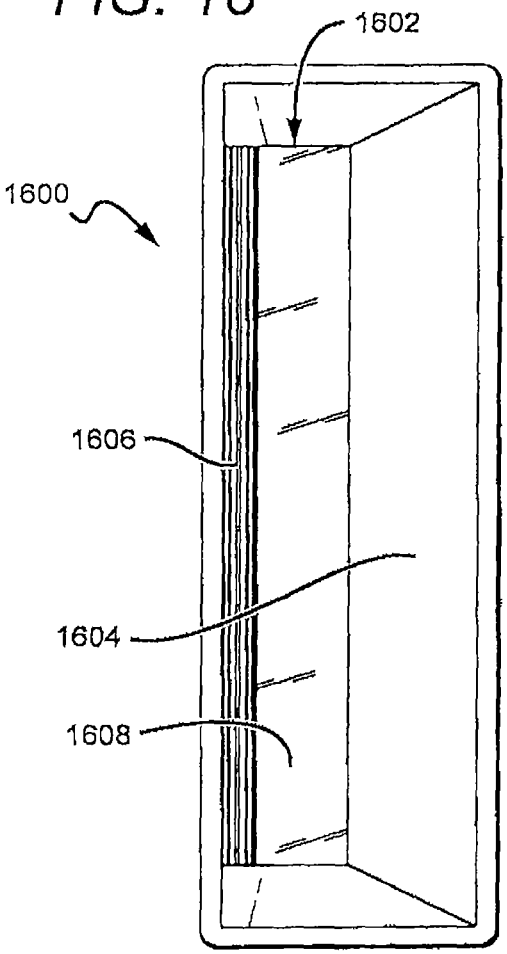
FIG. 16 is a bottom plan view of an asymmetrical troffer according to an embodiment of the present invention.

FIG. 16 is a bottom plan view of a troffer 1600 according to an embodiment of the present invention. This particular troffer 1600 is designed to function as a "wall-washer" type fixture. In some cases, it is desirable to light the area of a wall with higher intensity than the lighting in the rest of the room, for example, in an art gallery. The troffer 1600 is designed to directionally light an area to one side. Thus, the troffer 1600 comprises an asymmetrical light engine 1602 and pan 1604. An elongated heat sink 1606 is disposed proximate to a spine region of the back reflector (not shown) which is nearly flush against one side of the pan 1604. This embodiment may include a lens plate 1608 to improve color mixing and output uniformity. The inner structure of the troffer 1600 is similar to the inner structure of either half of the troffer 100. The light sources (occluded in this view) are mounted to the mount surface on the back side of the heat sink 1606. Many of the elements discussed in relation to the symmetrical embodiments disclosed herein can be used in an asymmetrical embodiment, such as the troffer 1600. It is understood that the troffer 1600 is merely one example of an asymmetrical troffer and that many variations are possible to achieve a particular directional output.

Figure 17:
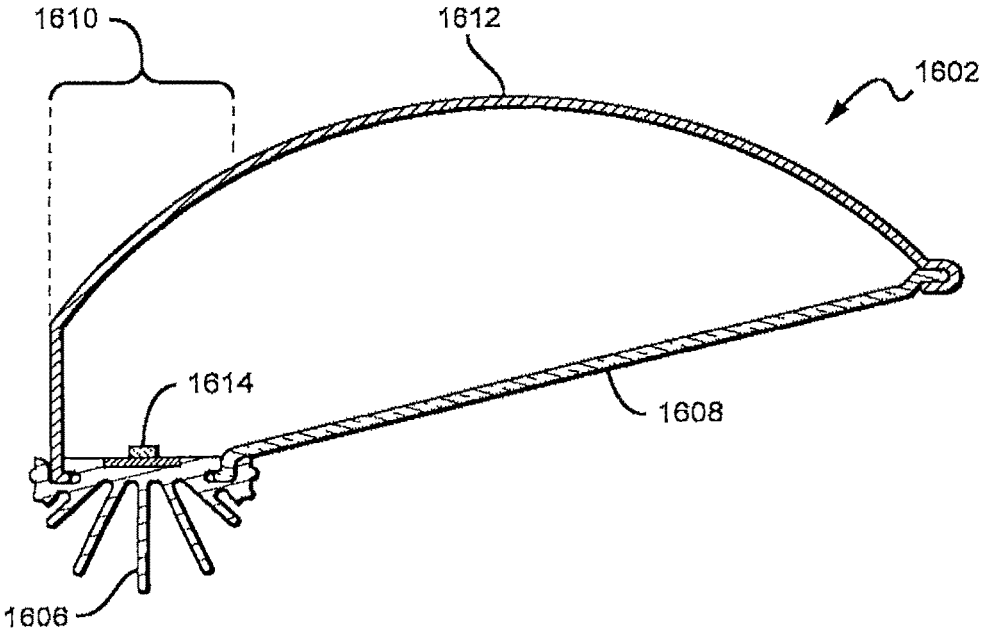
FIG. 17 is a cross-sectional view of a light engine unit according to an embodiment of the present invention.

FIG. 17 is a cross-sectional view of the light engine 1602 from troffer 1600. The heat sink 1606 is disposed proximate to the spine region 1610 of the back reflector 1612. One or more light sources 1614 are mounted on the back side of the heat sink 1606. The sources 1614 emit toward the back reflector 1612 where the light is diffused and redirected toward the transmissive lens plate 1608. Thus, the troffer 1600 comprises an asymmetrical structure to provide the directional emission to one side of the spine region 1610.

Figure 18:
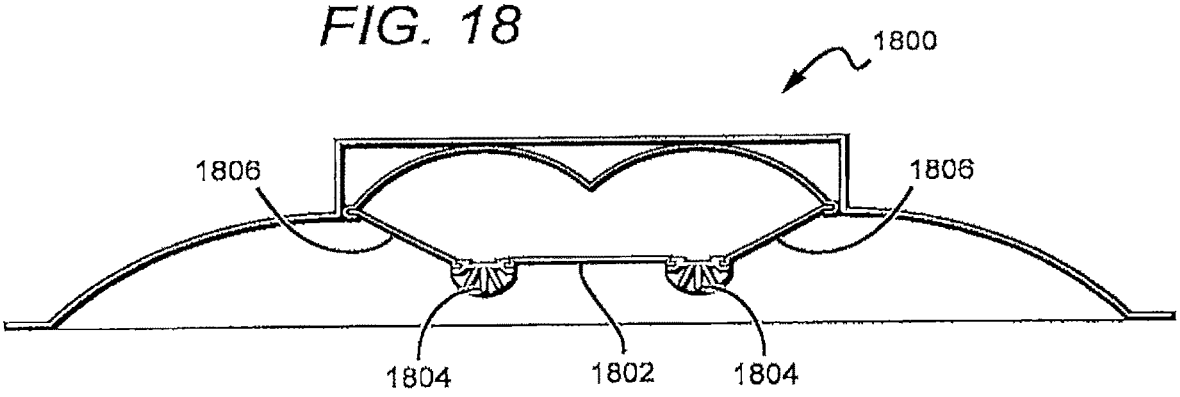
FIG. 18 is a cross-sectional view of a troffer according to an embodiment of the present invention.

Some embodiments may include multiple heat sinks similar to those shown in FIGS. 7*a* and 7*b*. FIG. 18 is a cross-sectional view of a troffer 1800 according to an embodiment of the present invention. In this embodiment a center lens plate 1802 can extend between parallel heat sinks 1804 with side lens plates 1806 extending from the heat sinks 1804 to the back reflector 1808. Additional heat sinks may be added in other embodiments such that consecutively arranged parallel heat sinks may have lens plates running between them with the heat sinks on the ends having lens plates extending therefrom to the back reflector as shown in FIGS. 4 and 5.

It is understood that embodiments presented herein are meant to be exemplary. Embodiments of the present invention can comprise any combination of compatible features shown in the various figures, and these embodiments should not be limited to those expressly illustrated and discussed.

Although the present invention has been described in detail with reference to certain preferred configurations thereof, other versions are possible. Therefore, the spirit and scope of the invention should not be limited to the versions described above.

We claim:

1. A wall washer lighting unit, comprising:

a back reflector defining a bottom edge and having a first longitudinal side and a second longitudinal side, the back reflector further comprising a longitudinal spine region that runs longitudinally down the back reflector adjacent the first longitudinal side;

a heat sink extending along the longitudinal spine region, the heat sink comprising a top-side mount surface, wherein a space between the heat sink and the back reflector defines an interior cavity; and a plurality of light emitters on the mount surface and aimed to emit light toward the back reflector, the mount surface facing the back reflector, and wherein the plurality of light emitters are substantially in line with the longitudinal spine region in a first direction;

the mount surface offset from the back reflector such that the mount surface is entirely below the bottom edge of the back reflector in a second direction perpendicular to the first direction.

2. The lighting unit of claim 1, wherein the back reflector defines an asymmetrical cross-section.

3. The lighting unit of claim 1, further comprising a lens plate that extends from the heat sink toward the second longitudinal side.

4. The lighting unit of claim 3, wherein the lens plate extends from the heat sink to the second longitudinal side.

5. The lighting unit of claim 4, wherein the heat sink is at least partially exposed.

6. The lighting unit of claim 1, wherein the plurality of light emitters combine to emit white light during operation.

7. The lighting unit of claim 1, wherein the back reflector comprises a diffuse white reflector.

8. The lighting unit of claim 1, further comprising a pan structure comprising an inner reflective surface defining a perimeter; the back reflector mounted inside of the pan structure such that the inner reflective surface surrounds the back reflector.

9. The lighting unit of claim 1, wherein the back reflector is one of parabolic, flat and corrugated.

10. A lighting unit, comprising:

a back reflector comprising a bottom edge;

a first heat sink and a second heat sink, the first heat sink comprising a first mount surface that faces towards a first area of the back reflector and the second heat sink comprising a second mount surface that faces towards a second area of the back reflector; and a first plurality of light emitters on the first mount surface and a second plurality of light emitters on the second mount surface, wherein the first plurality of light emitters and the second plurality of light emitters extend in a first direction;

the first heat sink and the second heat sink being offset from the back reflector such that the first heat sink and the second heat sink are below the bottom edge of the back reflector in a second direction perpendicular to the first direction.

11. The lighting unit of claim 10, wherein the first area and the second area are at least one of parabolic, flat and corrugated.

12. The lighting unit of claim 10, further comprising a center lens plate that extends between the first heat sink and the second heat sink.

13. The lighting unit of claim 12, further comprising a first side lens plate that extends from the first heat sink and a second side lens plate that extends from the second heat sink.

14. The lighting unit of claim 10, wherein the first heat sink is parallel to the second heat sink.

15. The lighting unit of claim 10, wherein the first heat sink and the second heat sink are at least partially exposed.

16. The lighting unit of claim 10, wherein the first plurality of light emitters and the second plurality of light emitters emit white light.

17. The lighting unit of claim 10, wherein the first mount surface comprises two flat areas each facing at an angle toward different portions of the first area.

18. The lighting unit of claim 10, further comprising a pan structure comprising an inner reflective surface defining a perimeter; the back reflector mounted inside of the pan structure such that the inner reflective surface at least partially surrounds the back reflector.

19. The lighting unit of claim 10, further comprising a central region between the first area and the second area.

20. The lighting unit of claim 19, wherein the central region comprises one of a flat center, and a shape defined by a vertex.

* * * * *